US010266930B2

(12) United States Patent
Branagan et al.

(10) Patent No.: US 10,266,930 B2
(45) Date of Patent: Apr. 23, 2019

(54) ALLOYS EXHIBITING SPINODAL GLASS MATRIX MICROCONSTITUENTS STRUCTURE AND DEFORMATION MECHANISMS

(71) Applicant: The NanoSteel Company, Inc., Providence, RI (US)

(72) Inventors: Daniel James Branagan, Idaho Falls, ID (US); Brian E. Meacham, Idaho Falls, ID (US); Jason K. Walleser, Idaho Falls, ID (US); Jikou Zhou, Pleasanton, CA (US); Alla V. Sergueeva, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 0 days.

(21) Appl. No.: 14/953,930

(22) Filed: Nov. 30, 2015

(65) Prior Publication Data

US 2016/0304998 A1 Oct. 20, 2016

Related U.S. Application Data

(63) Continuation of application No. 14/791,879, filed on Jul. 6, 2015, now abandoned, which is a continuation of application No. 13/118,035, filed on May 27, 2011, now abandoned.

(60) Provisional application No. 61/348,823, filed on May 27, 2010.

(51) Int. Cl.
*C21D 9/52* (2006.01)
*C22C 37/10* (2006.01)
(Continued)

(52) U.S. Cl.
CPC ..... *C22C 45/02* (2013.01); *C21D 9/525* (2013.01); *C22C 37/10* (2013.01); *C22C 38/002* (2013.01);
(Continued)

(58) Field of Classification Search
CPC ..... C22C 38/002; C22C 38/02; C22C 38/08; C22C 38/52; C22C 38/54; C22C 38/105
See application file for complete search history.

(56) References Cited

U.S. PATENT DOCUMENTS 1,793,529 A 2/1931 Taylor
4,439,236 A 3/1984 Ray
(Continued)

FOREIGN PATENT DOCUMENTS

CA 2735450 3/2010
CA 2742706 5/2010
(Continued)

OTHER PUBLICATIONS

International Search Report and Written Opinion dated Apr. 9, 2012 issued in related International Patent Application No. PCT/US2011/038425.

(Continued)

*Primary Examiner* — C Melissa Koslow
(74) *Attorney, Agent, or Firm* — Grossman, Tucker, Perreault & Pfleger, PLLC

(57) ABSTRACT

A method of forming an alloy composition including spinodal based glass matrix microconstituents. The method comprises melting an alloy composition comprising iron present in the range of 49 atomic percent (at %) to 65 at %, nickel present in the range of 10.0 at % to 16.5 at %, cobalt optionally present in the range of 0.1 at % to 12 at %, boron present in the range of 12.5 at % to 16.5 at %, silicon optionally present in the range of 0.1 at % to 8.0 at %, carbon optionally present in the range of 2 at % to 5 at %, chromium optionally present in the range of 2.5 at % to 13.35 at %, and niobium optionally present in the range of 1.5 at % to 2.5 at %, cooling the alloy composition at a rate of $10^3$ K/s to $10^6$ K/s.

16 Claims, 33 Drawing Sheets

(51) Int. Cl.

| | |
|---|---|
| ***C22C 38/00*** | (2006.01) |
| ***C22C 38/02*** | (2006.01) |
| ***C22C 38/08*** | (2006.01) |
| ***C22C 38/10*** | (2006.01) |
| ***C22C 38/34*** | (2006.01) |
| ***C22C 38/48*** | (2006.01) |
| ***C22C 38/52*** | (2006.01) |
| ***C22C 38/54*** | (2006.01) |
| ***C22C 38/56*** | (2006.01) |
| ***C22C 45/02*** | (2006.01) |

(52) U.S. Cl.

CPC ..... *C22C 38/02* (2013.01); *C22C 38/08* (2013.01); *C22C 38/105* (2013.01); *C22C 38/34* (2013.01); *C22C 38/48* (2013.01); *C22C 38/52* (2013.01); *C22C 38/54* (2013.01); *C22C 38/56* (2013.01)

(56) References Cited

U.S. PATENT DOCUMENTS

| | | | | |
|---|---|---|---|---|
| 4,515,870 | A * | 5/1985 | Bose et al. | 428/656 |
| 4,718,475 | A * | 1/1988 | Das | C22C 45/005 164/415 |
| 2001/0016026 | A1 | 8/2001 | Tennie | |
| 2002/0038680 | A1* | 4/2002 | Arai et al. | 148/301 |
| 2009/0078359 | A1 | 3/2009 | Boulay | |
| 2010/0065163 | A1 | 3/2010 | Branagan et al. | |
| 2010/0111747 | A1 | 5/2010 | Branagan et al. | |

FOREIGN PATENT DOCUMENTS

| | | |
|---|---|---|
| JP | H06224060 | 8/1984 |
| JP | S63317645 | 12/1988 |
| WO | 2010005745 | 1/2010 |
| WO | 2010048060 | 4/2010 |
| WO | 2010091087 | 8/2010 |
| WO | 2011053999 | 5/2011 |
| WO | 2011057221 | 5/2011 |
| WO | 2011097239 | 8/2011 |

OTHER PUBLICATIONS

Japanese Office Action dated Mar. 16, 2015 issued in related Japanese Patent Application No. 2013-512056.

Chinese Office Action dated Jul. 17, 2014 issued in related Chinese Patent Application No. 201180034755.8.

Branagan, et al., "Engineering magnetic nanocomposite microstructures," J. Mater. Sci. 35, 3459-3466 (2000).

Branagan, et al., "Wear resistant amorphous and nanocomposite steel coatings," Metall. Mater. Trans. A 32 2615-2621 (2001).

Branagan, et al., "Formation of nanoscale composite coatings via HVOF and wire-arc spraying," Proc. ITSC 2005, Basel, Switzerland, May 2-May 4, 2005, p. 539-544.

Decristofaro, "Amorphous Metals in Electric-Power Distribution Applications", MRS Bulletin, vol. 23, No. 5, 1198, 50-56.

Guo et al, "Tensile ductility and necking of metallic glass," Nature Mater. 6, 735-739 (2007).

Haseqawa et al., "Present status of amorphous soft magnetic alloys," J. Magn. Magn. Mater. 215-216, 240-245 (2000).

Herbst, et al., "R2Fe14B materials: Intrinsic properties and technological aspects," Rev. Modern Physics 63, 819-897 (1991).

Koch et al., "Ductility of nanostructured materials," Mater. Res. Soc. Bull. 24, 54-58 (1999).

Meyer et al., "Mechanical properties of nanocrystalline materials," Prog. Mater. Sci. 51, 427-556 (2006).

Sanders et al., "Elastic and tensile behavior of nanocrystalline copper and palladium," Acta Mater. 45, 4019-4025 (1997).

Schuh et al., "Mechanical behavior of amorphous alloys," Acta Mater. 55, 4067-4109 (2007).

Taylor, et al., "A Method of Drawing Metallic Filaments and a Discussion of their Properties and Uses," Physical Review, vol. 23, Issue 5, pp. 655-660.

Torre et al., "Deformation behaviour and microstructure of nanocrystalline electrodeposited and high pressure torsioned nickel," Acta Mater. 53, 2337-2349 (2005).

Varga et al., "The Influence of Size on Coercive Field of Ultra Soft Magnetic Materials," J. Magn., Magn. Mater. 301, 527-531 (2006).

Vereshchagin, et al., "Effect of Isochronous Annealing on the Formation of Shear Bands in the Vicinity of a Stress Concentrator on the Surface of Iron-Based Amorphous Alloys," J. Applied Mech. Tech. Phys., vol. 44, No. 5, pp. 681-684 (2003).

Zhang et al., "Difference in compressive and tensile fracture mechanisms of Zr59Cu20Al10Ni8Ti3 bulk metallic glass," Acta Mater. 51, 1167-1179 (2003).

Korean Office Action dated Feb. 16, 2017 issued in related Chinese Patent Application No. 10-2012-7033172.

Canadian Office Action dated Mar. 21, 2017 issued in related Canadian Patent Application No. 2,800,892.

European Search Report dated May 17, 2017 issued in related European Patent Application No. 11787532.8.

* cited by examiner

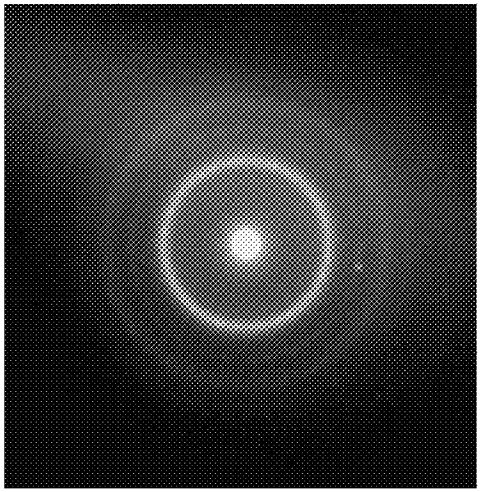
Figure 17*aii*
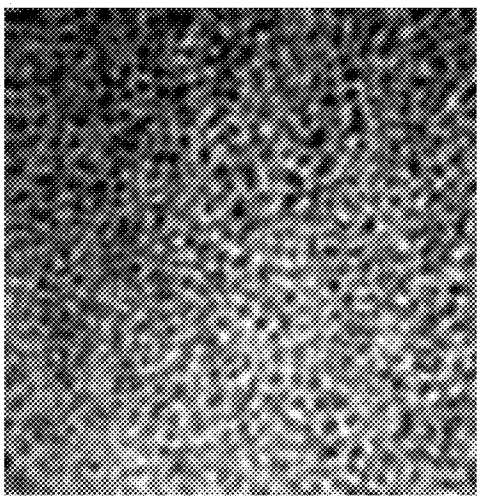
Figure 17*ai*

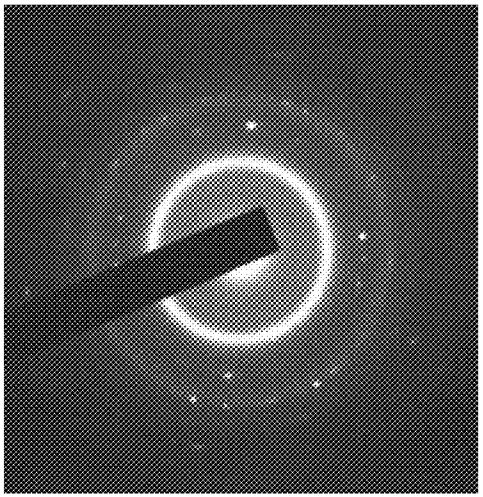
Figure 17b*ii*
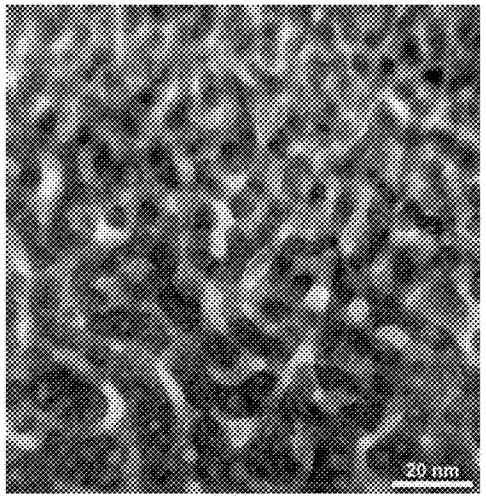
Figure 17b*i*

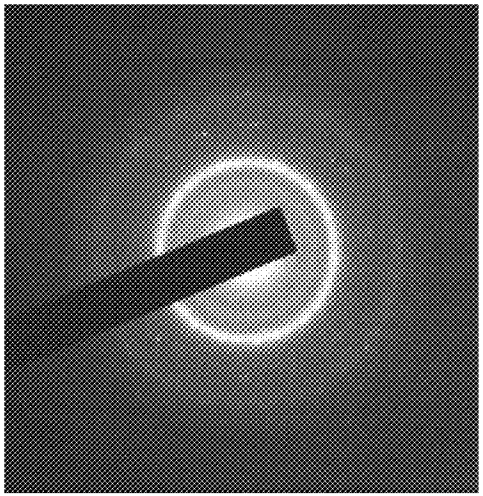
Figure 17*cii*
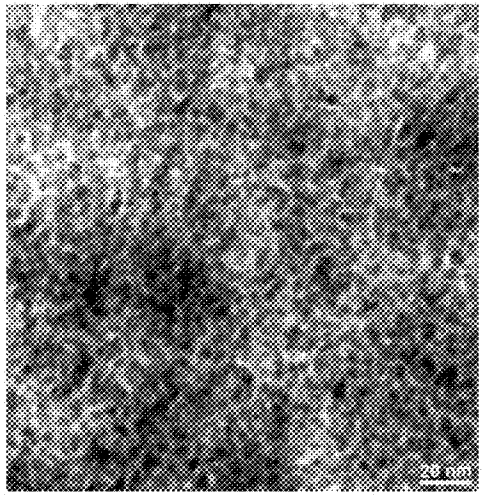
Figure 17*ci*

ALLOYS EXHIBITING SPINODAL GLASS MATRIX MICROCONSTITUENTS STRUCTURE AND DEFORMATION MECHANISMS

CROSS-REFERENCE TO RELATED APPLICATIONS

The present application is a continuation of prior U.S. patent application Ser. No. 14/791,879, filed on Jul. 6, 2015, now abandoned, which is a continuation of prior U.S. patent application Ser. No. 13/118,035, filed on May 27, 2011, now abandoned, which claims the benefit of the filing date of U.S. Provisional Application Ser. No. 61/348,823, filed on May 27, 2010, the teachings of which applications are incorporated herein by reference.

FIELD OF INVENTION

The present application relates to metallic compositions that are capable of developing plasticity at room temperature by triggering the formation of spinodal glass matrix microconstituent structures and an associated number of shear bands per linear unit.

BACKGROUND

Despite promising property combinations such as high hardness, tensile stress and fracture strength, practical applications of metallic glasses and nanomaterials have been relatively limited. One issue that has arisen in both material classes is that the materials may exhibit relatively brittle response. Commercial exploitation of these material classes has been facilitated by utilizing their soft and hard magnetic properties for applications including transformers and high energy density permanent magnets and, more recently, for surface technology applications whereby coatings including these materials may be applied to a surface to solve corrosion, erosion, and/or wear issues.

Although both metallic glasses and nanomaterials can show ductility when tested in compression, the same materials when tested in tension, may generally exhibit a tensile ductility which may be close to zero and fracture in a brittle manner. Due to the extremely fine length scale of the structural order (i.e. molecular associations) and near defect free nature of these materials (i.e. no 1-d dislocation or 2-d grain/phase boundary defects), relatively high strength may be obtained. However, due to the lack of crystallinity, dislocations may not be found and so far there does not appear to be a mechanism for significant (i.e. >2%) tensile elongation. Metallic glasses may exhibit relatively limited fracture toughness associated with the rapid propagation of shear bands and/or cracks which may be a concern for the technological utilization of these materials.

In metallic glasses deformed at room temperature, plastic deformation may be inhomogeneous with cooperative atomic reorganization in shear transformation zones, which may take place in thin bands of shear bands. In unconstrained loading such as under tension, shear bands may propagate in a runaway fashion followed by the commensurate nucleation of cracks, which may result in catastrophic failure. For nanocrystalline materials, as the grain size is progressively decreased, the formation of dislocation pile-ups may become more difficult and their movement may be limited by the large amount of 2-d defect phases and grain boundaries. Reductions in grain/phase size may render otherwise mobile dislocations immobile due to the effective disruption of slip systems in the grain/phase boundary area. As a result, the ability of nanoscale materials to exhibit significant levels of plastic deformation may be suppressed even in very ductile nanoscale FCC metals such as copper and nickel. Thus, the achievement of adequate ductility (>1%) in nanocrystalline materials has been a challenge. The inherent inability of these classes of material to be able to deform in tension at room temperature may be a relatively limiting factor for potential structural applications where intrinsic ductility may be needed to avoid catastrophic failure.

SUMMARY

An aspect of the present disclosure relates to an alloy composition. The alloy composition may include iron present in the range of 49 atomic percent (at %) to 65 at %, nickel present in the range of 10.0 at % to 16.5 at %, cobalt optionally present in the range of 0.1 at % to 12 at %, boron present in the range of 12.5 at % to 16.5 at %, silicon optionally present in the range of 0.1 at % to 8.0 at %, carbon optionally present in the range of 2 at % to 5 at %, chromium optionally present in the range of 2.5 at % to 13.35 at %, and niobium optionally present in the range of 1.5 at % to 2.5 at %, wherein the alloy composition exhibits spinodal glass matrix microconstituents when cooled at a rate in the range of $10^3$K/s to $10^4$K/s and develops a number of shear bands per linear meter in the range of greater than $1.1\times10^2$ $m^{-1}$ to $10^7$ $m^{-1}$ upon application of a tensile force applied at a rate of 0.001 $s^{-1}$.

BRIEF DESCRIPTION OF THE DRAWINGS

The above-mentioned and other features of this disclosure, and the manner of attaining them, will become more apparent and better understood by reference to the following description of embodiments described herein taken in conjunction with the accompanying drawings, wherein:

FIGS. 15*a* and 15*b* illustrates macrodefects in fibers produced from Alloy 8 by the hyperquenching process; wherein FIG. 15*a* illustrates the left side external surface and FIG. 15*b* illustrates a cross-section.

FIGS. 16*a*, 16*b* and 16*c* illustrate TEM micrographs of the SGMM structure in melt-spun ribbons; wherein FIG. 16*a* illustrates a TEM micrograph of Alloy 1; FIG. 16*b* illustrates a TEM micrograph of Alloy 4, and FIG. 16*c* illustrates a TEM micrograph of Alloy 8.

FIGS. 17*ai*, 17*aii*, 17*bi*, 17*bii*, 17*ci*, and 17*cii* illustrate TEM micrographs and SAED patterns of SGMM structure in microwires produced by the Taylor-Ulitovsky process; FIG. 17*ai*) illustrates TEM micrographs for Alloy 1 and FIG. 17*aii* illustrates SAED patterns for Alloy 1; FIG. 17*bi* illustrates TEM micrographs for Alloy 4 and FIG. 17*bii* illustrates SAED patterns for Alloy 4; and FIG. 17*ci* illustrates TEM micrographs for Alloy 8 and FIG. 17*cii* illustrates SAED patterns for Alloy 8.

FIG. 20*a* illustrates the wheel side ribbon surface (i.e., the surface of the ribbon which contacts the wheel during casting) and FIG. 20*b* illustrates the free side ribbon surface (i.e., the surface of the ribbon opposite the wheel during casting).

DETAILED DESCRIPTION

Figure 1:
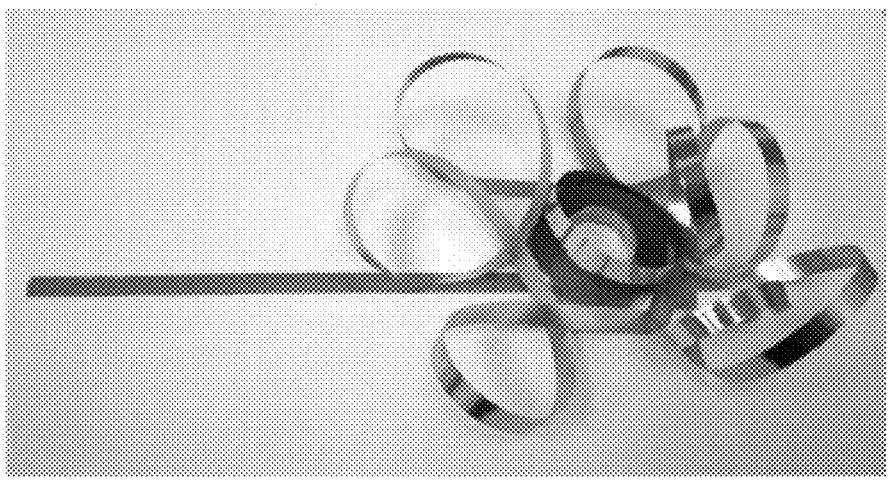
FIG. 1 illustrates an example of foil produced from Alloy 1 by the Planar Flow Casting process.
Figure 2A:
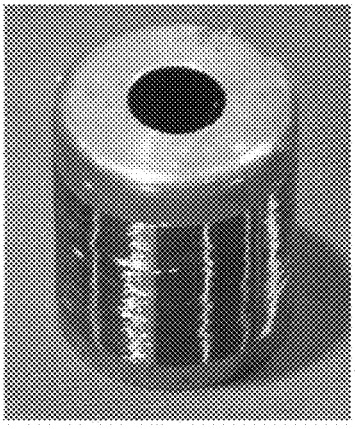
FIGS. 2*a* and 2*b* illustrate an example of microwire produced from Alloy 2 by the Taylor-Ulitovsky process.
Figure 2B:
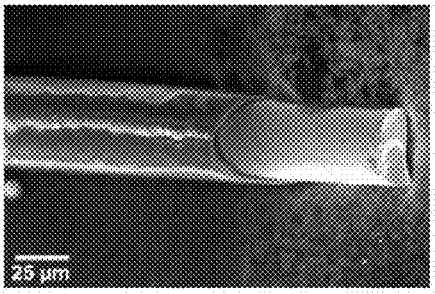
Figure 3:
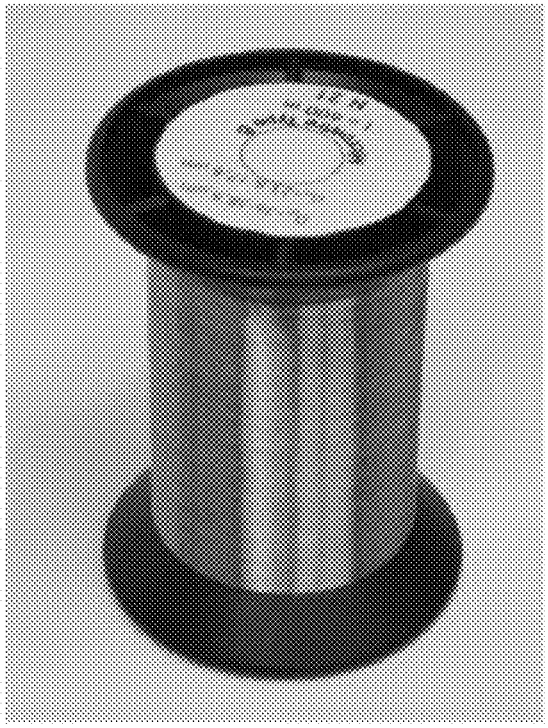
FIG. 3 illustrates microwire produced from Alloy 3 by the Taylor-Ulitovsky process.
Figure 4:
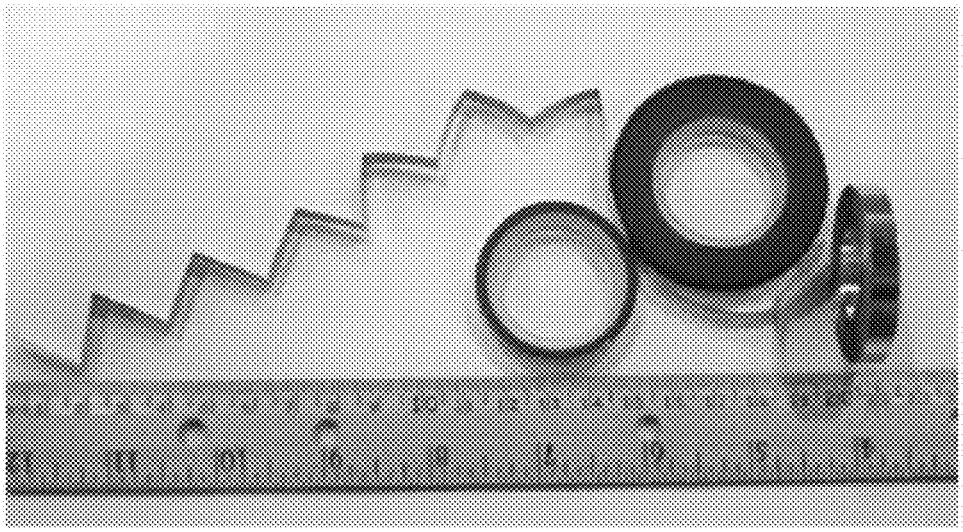
FIG. 4 illustrates foils produced from Alloy 4 by the Planar Flow Casting process.
Figure 5:
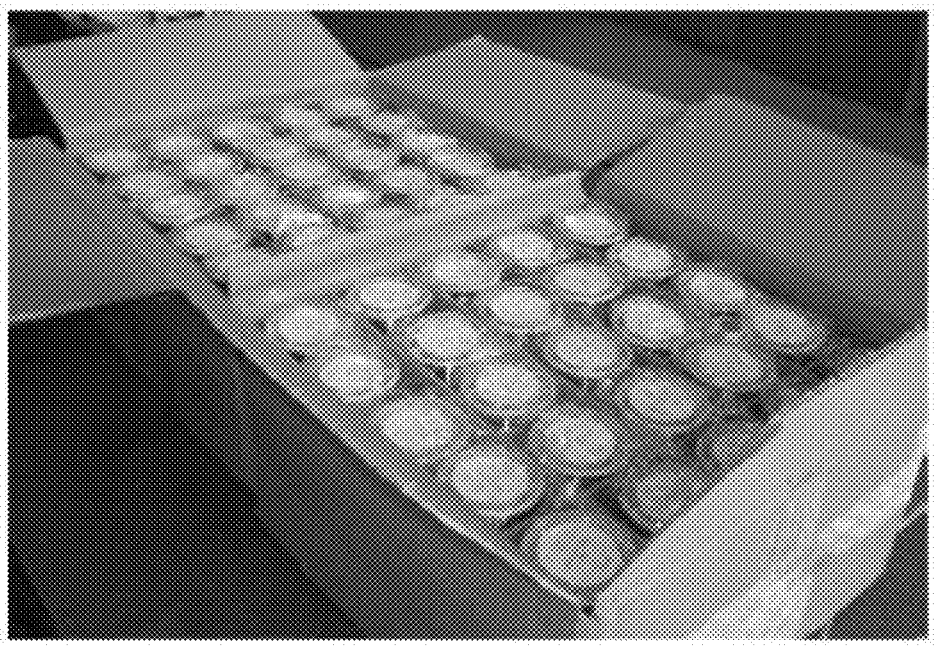
FIG. 5 illustrates microwires produced from Alloy 4 by the Taylor-Ulitovsky process.
Figure 6:
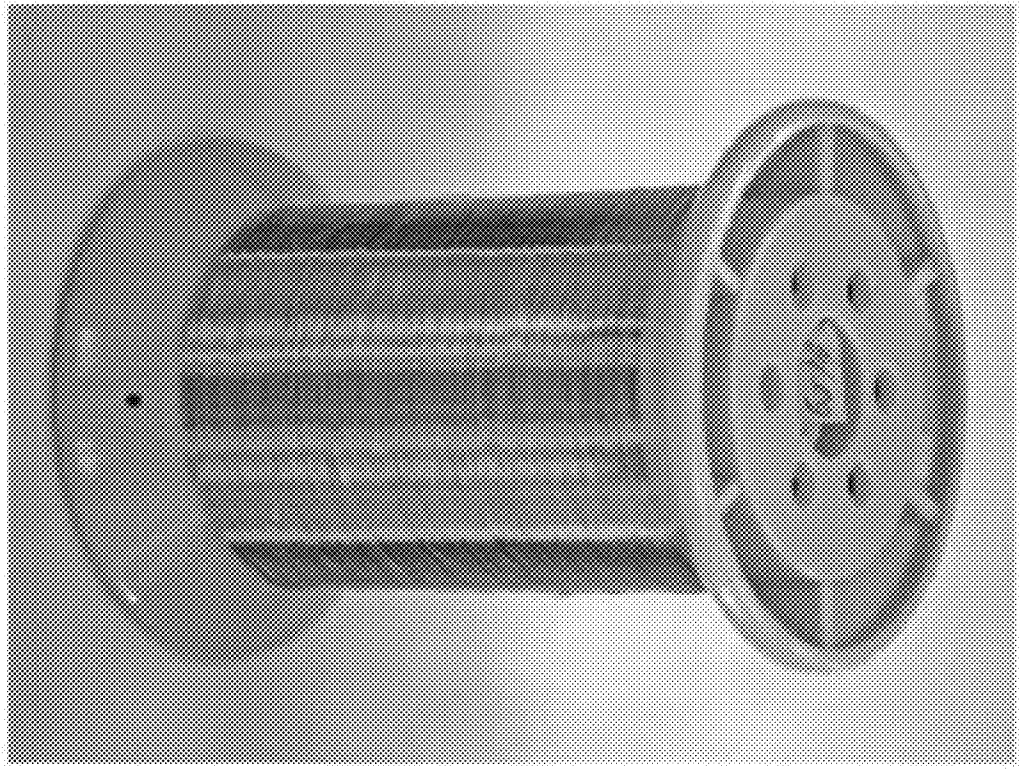
FIG. 6 illustrates microwire produced from Alloy 5 by the Taylor-Ulitovsky process.
Figure 7:
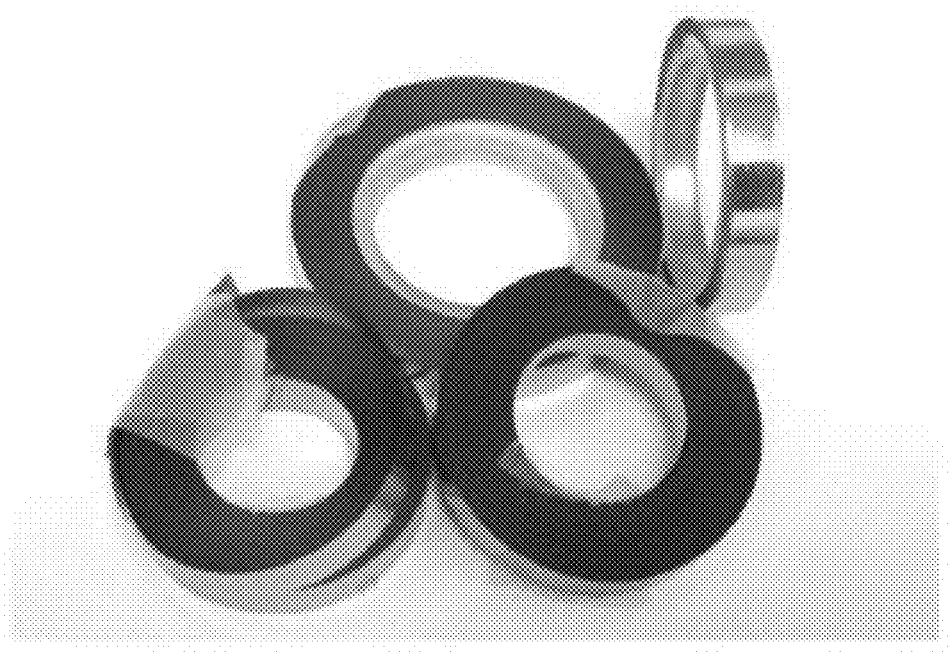
FIG. 7 illustrates foils produced from Alloy 6 by the Planar Flow Casting process.
Figure 8A:
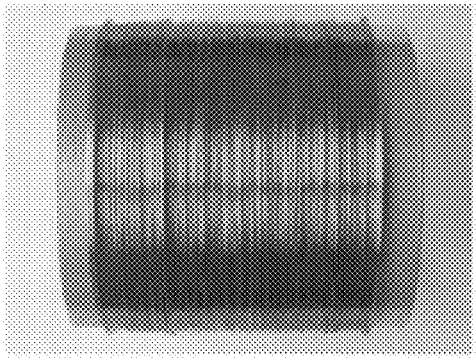
FIGS. 8*a* and 8*b* illustrate microwire produced from Alloy 7 by the Taylor-Ulitovsky process.
Figure 8B:
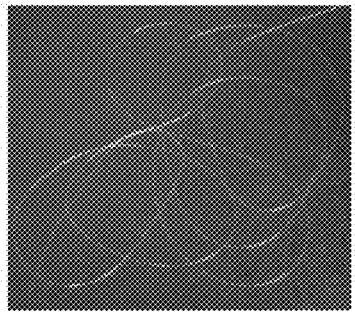
Figure 9:
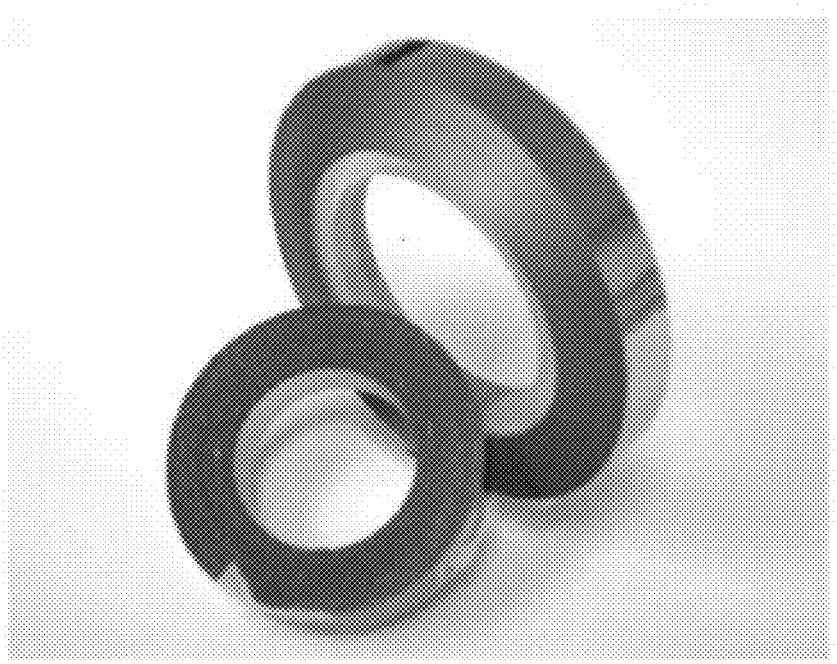
FIG. 9 illustrates foils produced from Alloy 8 produced by the Planar Flow Casting process.
Figure 10:
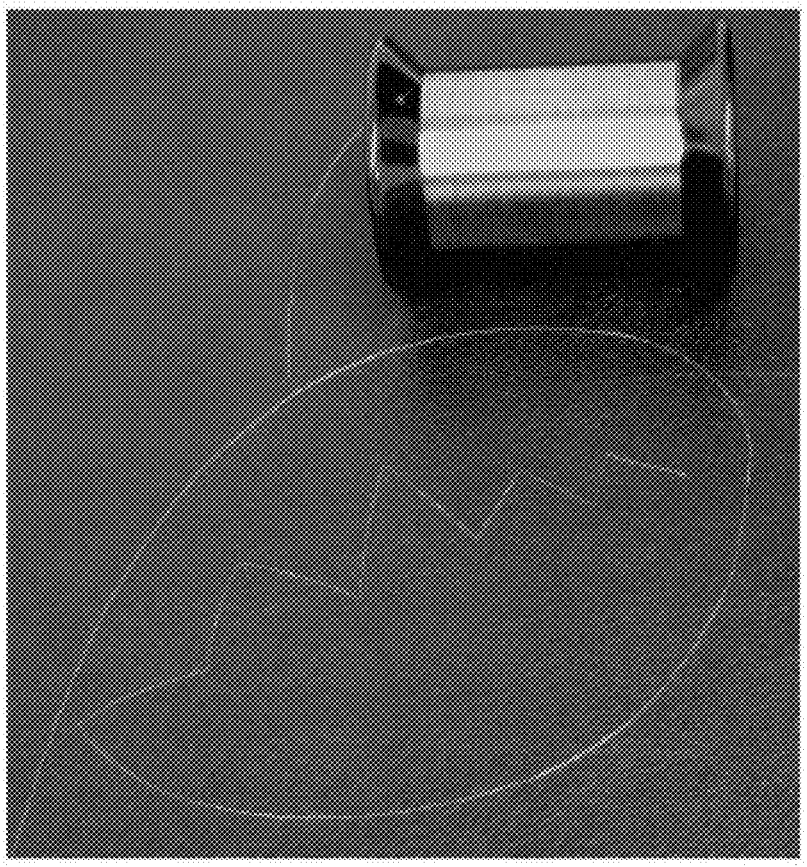
FIG. 10 illustrates microwire produced from Alloy 8 by the Taylor-Ulitovsky process.
Figure 11:
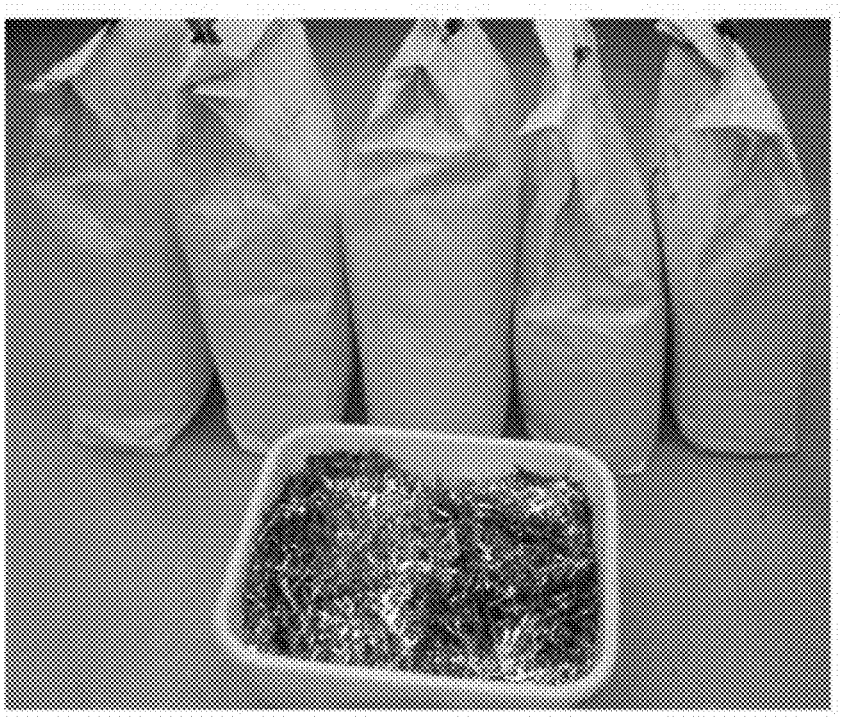
FIG. 11 illustrates fibers produced from Alloy 8 by the Hyperquenching process.
Figure 12:
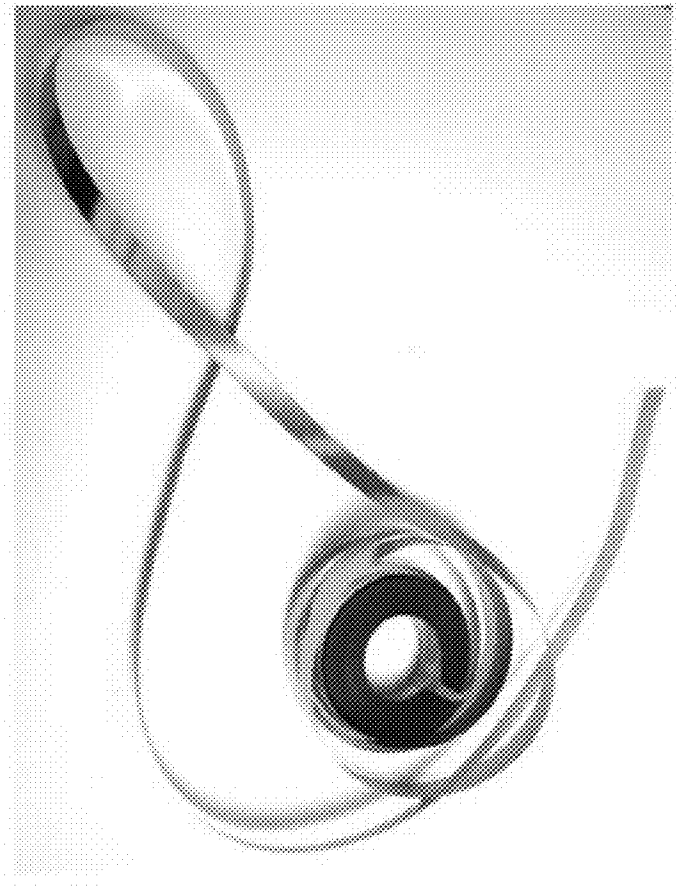
FIG. 12 illustrates a foil produced from Alloy 9 by the Planar Flow Casting process.

The present application relates to metallic glass forming chemistries which may be triggered to form spinodal glass matrix microconstituent (SGMM) structures that exhibit relatively significant ductility (elongations of greater than or equal to ~1.0%) and high tensile strength (greater than or equal to 2.35 GPa for wire and greater than or equal to 0.62 GPa for fibers). In addition, the alloys herein may be configured to provide shear band per linear meter of greater than $1.1\times10^2$ $m^{-1}$ to $10^7$ $m^1$.

Spinodal microconstituents may be understood as microconstituents formed by a transformation mechanism which is not nucleation controlled. More basically, spinodal decomposition may be understood as a mechanism by which a solution of two or more components (e.g. metal compositions) of the alloy can separate into distinct regions (or phases) with distinctly different chemical compositions and physical properties. This mechanism differs from classical nucleation in that phase separation may occur uniformly throughout the material and not just at discrete nucleation sites. One or more semicrystalline clusters or crystalline phases may therefore form through a successive diffusion of atoms on a local level until the chemistry fluctuations lead to at least one distinct crystalline phase. Semi-crystalline clusters may be understood herein as exhibiting a largest linear dimension of 2 nm or less, whereas crystalline clusters may exhibit a largest linear dimension of greater than 2 nm. Note that during the early stages of the spinodal decomposition, the clusters which are formed may be relatively small and while their chemistry differs from the glass matrix, they are not yet fully crystalline and have not yet achieved well ordered crystalline periodicity. Additional crystalline phases may exhibit the same crystal structure or distinct structures. Furthermore the glass matrix may be understood to include microstructures that may exhibit associations of structural units in the solid phase that may be randomly packed together. The level of refinement, or the size, of the structural units may be in the angstrom scale range (i.e. 5 Å to 100 Å) and additionally may range up in size up to the nm range (10 to 100 nm). Examples of the SGMM structure are included in the Case Examples in this application.

In addition, the alloys may be triggered to provide deformation responses including Induced Shear Band Blunting (ISBB) and Shear Band Arresting Interactions (SBAI) which are associated with the spinodal glass matrix microconstituent (SGMM). ISBB involves the ability to blunt and stop propagating shear bands through interactions with the SGMM structure. SBAI involves arresting of shear bands through shear band/shear band interactions and occur after the initial or primary shear bands are blunted through ISBB.

While conventional materials deform through dislocations moving on specific slip systems in crystalline metals, the alloys herein are configured to involve moving shear bands (i.e., discontinuities where localized deformation occurs) in a spinodal glass matrix microconstituent which are blunted by localized deformation induced changes (LDIC). LDIC is described further herein. With increasing levels of stress, once a shear band is blunted, new shear bands may be nucleated and then interact with existing shear bands creating relatively high shear band densities in tension and the development of relatively significant levels of plasticity. Thus, the alloys herein with the triggered SGMM structures are capable of preventing or mitigating shear band propagation in tension, which results in relatively significant tensile ductility (≥1% elongation) and leads to strain hardening during tensile testing. Specific examples of the alloys and their properties are included in the Case Examples reported below.

Glass forming chemistries that may be used to form compositions including the spinodal glass matrix microconstituent structures may include certain iron based glass forming alloys which are then processed to provide the SGMM structures noted herein.

The operable system size may be defined as the volume of material containing the SGMM structure. Additionally, for a liquid melt cooling on a chill surface such as a wheel or roller (which can be as wide as engineering will allow) 2-dimensional cooling dominates so the thickness will be the limiting factor on structure formation and resulting operable system size. At thicknesses above a reasonable system size compared to the mechanism size, the ductility mechanism will be unaffected. For example, the shear band widths are relatively small (10 to 100 nm) and even with the LDIC interactions with the structure the interaction size is from 20 to 200 nm. Thus, for example, achievement of significant ductility (≥1%) at a 100 micron thickness means that the system thickness is already 500 to 10,000 times greater than ductility mechanism sizes. The operable system size which when exceeded would allow for ISBB and SBAI interactions would be ~1 micron in thickness or 1 $\mu m^3$ in volume. Achieving thicknesses greater ~1 micron or operable volumes greater 1 $\mu m^3$ would not be expected to significantly affect the operable mechanisms or achievement of significant levels of plasticity. Thus, greater thickness or greater volume samples or products would be contemplated to achieve an operable ductility with ISBB and SBAI mechanisms in a similar fashion as identified as long as the SGMM structure is formed.

In one embodiment, the glass forming alloys may include iron present at atomic ratios of 44 to 59, including all values and increments therein, nickel may be present at atomic ratios of 13 to 15, including all values and increments therein, cobalt may be present at atomic ratios of 2 to 11, including all values and increments therein, boron may be present at atomic ratios of 11 to 15, including all values and increments therein, silicon may be present at atomic ratios of 0.4 to 8, including all values and increments therein, carbon may optionally be present at atomic ratios of 1.5 to 4.5, including all values and increments therein, chromium may optionally be present at atomic ratios of 2 to 3, including all values and increments therein, and niobium may optionally be present at atomic ratios of 1.5 to 2.0, including all values and increments therein. The above atomic ratios may be understood as the ratio of the given element to the remainder of the elements present in the base alloys composition. It may be appreciated that the base alloy composition may be present in the range of 70 to 100 percent of a given glass forming chemistry, including all values and ranges therein, such as one or more values or ranges selected from the following: 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100.

Accordingly, it may be appreciated that iron may be present at one or more atomic ratios selected from the following 44.0, 44.1, 44.2, 44.3, 44.4, 44.5, 44.6, 44.7, 44.8, 44.9, 45.0, 45.1, 45.2, 45.3, 45.4, 45.5, 45.6, 45.7, 45.8, 45.9, 46.0, 46.1, 46.2, 46.3, 46.4, 46.5, 46.6, 46.7, 46.8, 46.9, 47.0, 47.1, 47.2, 47.3, 47.4, 47.5, 47.6, 47.7, 47.8, 47.9, 48.0, 48.1, 48.2, 48.3, 48.4, 48.5, 48.6, 48.7, 48.8, 48.9, 49.0, 49.1, 49.2, 49.3, 49.4, 49.5, 49.6, 49.7, 49.8, 49.9, 50.0, 50.1, 50.2, 50.3, 50.4, 50.5, 50.6, 50.7, 50.8, 50.9, 51.0, 51.1, 51.2, 51.3, 51.4, 51.5, 51.6, 51.7, 51.8, 51.9, 52.0, 52.1, 52.2, 52.3, 52.4, 52.5, 52.6, 52.7, 52.8, 52.9, 53.0, 53.1, 53.2, 53.3, 53.4, 53.5, 53.6, 53.7, 53.8, 53.9, 54.0, 54.1, 54.2, 54.3, 54.4, 54.5, 54.6, 54.7, 54.8, 54.9, 55.0, 55.1, 55.2, 55.3, 55.4, 55.5, 55.6, 55.7, 55.8, 55.9, 56.0, 56.1, 56.2, 56.3, 56.4, 56.5, 56.6, 56.7, 56.8, 56.9, 57.0, 57.1, 57.2, 57.3, 57.4, 57.5, 57.6, 57.7, 57.8, 57.9, 58.0, 58.1, 58.2, 58.3, 58.4, 58.5, 58.6, 58.7, 58.8, 58.9, or 59.0, nickel may be present at one or more atomic ratios selected from the following: of 10.0, 10.1, 10.2, 10.3, 10.4, 10.5, 10.6, 10.7, 10.8, 10.9, 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, or 15.0, cobalt may optionally be present at one or more atomic ratios selected from the following: 0.1, 0.2 0.3 0.4 0.5 0.6 0.7, 0.8, 0.9, 1.0, 1.1, 1.2, 1.3, 1.4 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, or 11.0, boron may be present at one or more atomic ratios selected from the following: 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, 14.0, 14.1, 14.2, 14.3, 14.4, 14.5, 14.6, 14.7, 14.8, 14.9, or 15.0, silicon optionally may be present at one or more atomic ratios selected from the following: 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, or 8.0, carbon may be present at one or more atomic ratios selected from the following: 0, 1.5, 1.6, 1.7, 1.8, 1.9, 2, 2.1, 2.2, 2.3, 2.4, 2.5, 2.6, 2.7, 2.8, 2.9, 3, 3.1, 3.2, 3.3, 3.4, 3.5, 3.6, 3.7, 3.8, 3.9, 4, 4.1, 4.2, 4.3, 4.4, or 4.5, chromium may be present at one or more atomic ratios selected from the following: 0, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9, 4.0, 4.1, 4.2, 4.3, 4.4, 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, 6.5, 6.6, 6.7, 6.8, 6.9, 7.0, 7.1, 7.2, 7.3, 7.4, 7.5, 7.6, 7.7, 7.8, 7.9, 8.0, 8.1, 8.2, 8.3, 8.4, 8.5, 8.6, 8.7, 8.8, 8.9, 9.0, 9.1, 9.2, 9.3, 9.4, 9.5, 9.6, 9.7, 9.8, 9.9, 10.0, 10.1, 10.2, 10.3, 10.4, 10.5, 10.6, 10.7, 10.8, 10.9, or 11.0, 11.1, 11.2, 11.3, 11.4, 11.5, 11.6, 11.7, 11.8, 11.9, 12.0, 12.1, 12.2, 12.3, 12.4, 12.5, 12.6, 12.7, 12.8, 12.9, 13.0, 13.1, 13.2, 13.3, 13.4, 13.5, 13.6, 13.7, 13.8, 13.9, or 14.0 and niobium may be present at one or more atomic ratios selected from the following: 0, 1.5, 1.6, 1.7, 1.8, 1.9, or 2.0. The atomic ratios being that of the base alloy composition.

In another embodiment, the glass forming chemistries which may form the SGMM may include, consist of or consist essentially of iron present in the range of 49 atomic percent (at %) to 65 at %, nickel present in the range of 10.0 at % to 16.5 at %, cobalt optionally present in the range of 0.1 at % to 12 at %, boron present in the range of 12.5 at % to 16.5 at %, silicon optionally present in the range of 0.1 at % to 8.0 at %, carbon optionally present in the range of 2 at % to 5 at %, chromium optionally present in the range of 2.5 at % to 13.35 at %, and niobium optionally present in the range of 1.5 at % to 2.5 at %. It may be appreciated that up to 10 at % of the composition may include impurities. Again the atomic percents may be that of a base alloy composition, which may be present in the glass forming chemistry in the range of 70 at % to 100 at %, including all values and increments therein, such as 70 at %, 71 at %, 72 at %, 73 at %, 74 at %, 75 at %, 76 at %, 77 at %, 78 at %, 79 at %, 80 at %, 81 at %, 82 at %, 83 at %, 84 at %, 85 at %, 86 at %, 87 at %, 88 at %, 89 at %, 90 at %, 91 at %, 92 at %, 93 at %, 94 at %, 95 at %, 96 at %, 97 at %, 98 at %, 99 at %, 100 at %. For example, it may be appreciated that up to 10 at % of the composition may include impurities.

It may be appreciated that iron may be present at one or more of the following atomic percentages: 49.0 at %, 49.1 at %, 49.2 at %, 49.3 at %, 49.4 at %, 49.5 at %, 49.6 at %, 49.7 at %, 49.8 at %, 49.9 at %, 50.0 at %, 50.1 at %, 50.2 at %, 50.3 at %, 50.4 at %, 50.5 at %, 50.6 at %, 50.7 at %, 50.8 at %, 50.9 at %, 51.0 at %, 51.1 at %, 51.2 at %, 51.3 at %, 51.4 at %, 51.5 at %, 51.6 at %, 51.7 at %, 51.8 at %, 51.9 at %, 52.0 at %, 52.1 at %, 52.2 at %, 52.3 at %, 52.4 at %, 52.5 at %, 52.6 at %, 52.7 at %, 52.8 at %, 52.9 at %, 53.0 at %, 53.1 at %, 53.2 at %, 53.3 at %, 53.4 at %, 53.5 at %, 53.6 at %, 53.7 at %, 53.8 at %, 53.9 at %, 54.0 at %, 54.1 at %, 54.2 at %, 54.3 at %, 54.4 at %, 54.5 at %, 54.6 at %, 54.7 at %, 54.8 at %, 54.9 at %, 55.0 at %, 55.1 at %, 55.2 at %, 55.3 at %, 55.4 at %, 55.5 at %, 55.6 at %, 55.7 at %, 55.8 at %, 55.9 at %, 56.0 at %, 56.1 at %, 56.2 at %, 56.3 at %, 56.4 at %, 56.5 at %, 56.6 at %, 56.7 at %, 56.8 at %, 56.9 at %, 57.0 at %, 57.1 at %, 57.2 at %, 57.3 at %, 57.4 at %, 57.5 at %, 57.6 at %, 57.7 at %, 57.8 at %, 57.9 at %, 58.0 at %, 58.1 at %, 58.2 at %, 58.3 at %, 58.4 at %, 58.5 at %, 58.6 at %, 58.7 at %, 58.8 at %, 58.9 at %, 59.0 at %, 59.1 at %, 59.2 at %, 59.3 at %, 59.4 at %, 59.5 at %, 59.6 at %, 59.7 at %, 59.8 at %, 59.9 at %, 60.0 at %, 60.1 at %, 60.2 at %, 60.3 at %, 60.4 at %, 60.5 at %, 60.6 at %, 60.7 at %, 60.8 at %, 60.9 at %, 61.0 at %, 61.1 at %, 61.2 at %, 61.3 at %, 61.4 at %, 61.5 at %, 61.6 at %, 61.7 at %, 61.8 at %, 61.9 at %, 62.0 at %, 62.1 at %, 62.2 at %, 62.3 at %, 62.4 at %, 62.5 at %, 62.6 at %, 62.7 at %, 62.8 at %, 62.9 at %, 63.0 at %, 63.1 at %, 63.2 at %, 63.3 at %, 63.4 at %, 63.5 at %, 63.6 at %, 63.7 at %, 63.8 at %, 63.9 at %, 64.0 at %, 64.1 at %, 64.2 at %, 64.3 at %, 64.4 at %, 64.5 at %, 64.6 at %, 64.7 at %, 64.8 at %, 64.9 at %, or 65.0 at %, nickel may be present at one or more of the following atomic percentages: 10.0 at %, 10.1 at %, 10.2 at %, 10.3 at %, 10.4 at %, 10.5 at %, 10.6 at %, 10.7 at %, 10.8 at %, 10.9 at %, 11.0 at %, 11.1 at %, 11.2 at %, 11.3 at %, 11.4 at %, 11.5 at %, 11.6 at %, 11.7 at %, 11.8 at %, 11.9 at %, or 12.0 at %, 12.5 at %, 12.6 at %, 12.7 at %, 12.8 at %, 12.9 at %, 13.0 at %, 13.1 at %, 13.2 at %, 13.3 at %, 13.4 at %, 13.5 at %, 13.6 at %, 13.7 at %, 13.8 at %, 13.9 at %, 14.0 at %, 14.1 at %, 14.2 at %, 14.3 at %, 14.4 at %, 14.5 at %, 14.6 at %, 14.7 at %, 14.8 at %, 14.9 at %, 15.0 at %, 15.1 at %, 15.2 at %, 15.3 at %, 15.4 at %, 15.5 at %, 15.6 at %, 15.7 at %, 15.8 at %, 15.9 at %, 16.0 at %, 16.1 at %, 16.2 at %, 16.3 at %, 16.4 at %, or 16.5 at %, cobalt may be present at one or more of the following atomic percentages: 0.0 at %, 0.1 at %, 0.2 at %, 0.3 at %, 0.4 at %, 0.5 at %, 0.6 at %, 0.7 at %, 0.8 at %, 0.9 at %, 1.0 at %, 1.1 at %, 1.2 at %, 1.3 at %, 1.4 at %, 1.5 at %, 1.6 at %, 1.7 at %, 1.8 at %, 1.9 at %, 2.0 at %, 2.1 at %, 2.2 at %, 2.3 at %, 2.4 at %, 2.5 at %, 2.6 at %, 2.7 at %, 2.8 at %, 2.9 at %, 3.0 at %, 3.1 at %, 3.2 at %, 3.3 at %, 3.4 at %, 3.5 at %, 3.6 at %, 3.7 at %, 3.8 at %, 3.9 at %, 4.0 at %, 4.1 at %, 4.2 at %, 4.3 at %, 4.4 at %, 4.5 at %, 4.6 at %, 4.7 at %, 4.8 at %, 4.9 at %, 5.0 at %, 5.1 at %, 5.2 at %, 5.3 at %, 5.4 at %, 5.5 at %, 5.6 at %, 5.7 at %, 5.8 at %, 5.9 at %, 6.0 at %, 6.1 at %, 6.2 at %, 6.3 at %, 6.4 at %, 6.5 at %, 6.6 at %, 6.7 at %, 6.8 at %, 6.9 at %, 7.0 at %, 7.1 at %, 7.2 at %, 7.3 at %, 7.4 at %, 7.5 at %, 7.6 at %, 7.7 at %, 7.8 at %, 7.9 at %, 8.0 at %, 8.1 at %, 8.2 at %, 8.3 at %, 8.4 at %, 8.5 at %, 8.6 at %, 8.7 at %, 8.8 at %, 8.9 at %, 9.0 at %, 9.1 at %, 9.2 at %, 9.3 at %, 9.4 at %, 9.5 at %, 9.6 at %, 9.7 at %, 9.8 at %, 9.9 at %, 10.0 at %, 10.1 at %, 10.2 at %, 10.3 at %, 10.4 at %, 10.5 at %, 10.6 at %, 10.7 at %, 10.8 at %, 10.9 at %, 11.0 at %, 11.1 at %, 11.2 at %, 11.3 at %, 11.4 at %, 11.5 at %, 11.6 at %, 11.7 at %, 11.8 at %, 11.9 at %, or 12.0 at %, boron may be present at one or more of the following atomic percentages: 12.5 at %, 12.6 at %, 12.7 at %, 12.8 at %, 12.9 at %, 13.0 at %, 13.1 at %, 13.2 at %, 13.3 at %, 13.4 at %, 13.5 at %, 13.6 at %, 13.7 at %, 13.8 at %, 13.9 at %, 14.0 at %, 14.1 at %, 14.2 at %, 14.3 at %, 14.4 at %, 14.5 at %, 14.6 at %, 14.7 at %, 14.8 at %, 14.9 at %, 15.0 at %, 15.1 at %, 15.2 at %, 15.3 at %, 15.4 at %, 15.5 at %, 15.6 at %, 15.7 at %, 15.8 at %, 15.9 at %, 16.0 at %, 16.1 at %, 16.2 at %, 16.3 at %, 16.4 at %, or 16.5 at %, silicon may be present at one or more of the following atomic percentages: 0.0 at %, 0.1 at %, 0.2 at %, 0.3 at %, 0.4 at %, 0.5 at %, 0.6 at %, 0.7 at %, 0.8 at %, 0.9 at %, 1.0 at %, 1.1 at %, 1.2 at %, 1.3 at %, 1.4 at %, 1.5 at %, 1.6 at %, 1.7 at %, 1.8 at %, 1.9 at %, 2.0 at %, 2.1 at %, 2.2 at %, 2.3 at %, 2.4 at %, 2.5 at %, 2.6 at %, 2.7 at %, 2.8 at %, 2.9 at %, 3.0 at %, 3.1 at %, 3.2 at %, 3.3 at %, 3.4 at %, 3.5 at %, 3.6 at %, 3.7 at %, 3.8 at %, 3.9 at %, 4.0 at %, 4.1 at %, 4.2 at %, 4.3 at %, 4.4 at %, 4.5 at %, 4.6 at %, 4.7 at %, 4.8 at %, 4.9 at %, 5.0 at %, 5.1 at %, 5.2 at %, 5.3 at %, 5.4 at %, 5.5 at %, 5.6 at %, 5.7 at %, 5.8 at %, 5.9 at %, 6.0 at %, 6.1 at %, 6.2 at %, 6.3 at %, 6.4 at %, 6.5 at %, 6.6 at %, 6.7 at %, 6.8 at %, 6.9 at %, 7.0 at %, 7.1 at %, 7.2 at %, 7.3 at %, 7.4 at %, 7.5 at %, 7.6 at %, 7.7 at %, 7.8 at %, 7.9 at %, or 8.0 at %, carbon may be present at one or more of the following atomic percentages: 0 at %, 2.0 at %, 2.1 at %, 2.2 at %, 2.3 at %, 2.4 at %, 2.5 at %, 2.6 at %, 2.7 at %, 2.8 at %, 2.9 at %, 3.0 at %, 3.1 at %, 3.2 at %, 3.3 at %, 3.4 at %, 3.5 at %, 3.6 at %, 3.7 at %, 3.8 at %, 3.9 at %, 4.0 at %, 4.1 at %, 4.2 at %, 4.3 at %, 4.4 at %, 4.5 at %, 4.6 at %, 4.7 at %, 4.8 at %, 4.9 at %, or 5.0 at %, chromium may be present at one or more of the following atomic percentages: 0 at %, 2.5 at %, 2.6 at %, 2.7 at %, 2.8 at %, 2.9 at %, or 3.0 at %, 3.1 at %, 3.2 at %, 3.3 at %, 3.4 at %, 3.5 at %, 3.6 at %, 3.7 at %, 3.8 at %, 3.9 at %, 4.0 at %, 4.1 at %, 4.2 at %, 4.3 at %, 4.4 at %, 4.5 at %, 4.6 at %, 4.7 at %, 4.8 at %, 4.9 at %, 5.0 at %, 5.1 at %, 5.2 at %, 5.3 at %, 5.4 at %, 5.5 at %, 5.6 at %, 5.7 at %, 5.8 at %, 5.9 at %, 6.0 at %, 6.1 at %, 6.2 at %, 6.3 at %, 6.4 at %, 6.5 at %, 6.6 at %, 6.7 at %, 6.8 at %, 6.9 at %, 7.0 at %, 7.1 at %, 7.2 at %, 7.3 at %, 7.4 at %, 7.5 at %, 7.6 at %, 7.7 at %, 7.8 at %, 7.9 at %, 8.0 at %, 8.1 at %, 8.2 at %, 8.3 at %, 8.4 at %, 8.5 at %, 8.6 at %, 8.7 at %, 8.8 at %, 8.9 at %, 9.0 at %, 9.1 at %, 9.2 at %, 9.3 at %, 9.4 at %, 9.5 at %, 9.6 at %, 9.7 at %, 9.8 at %, 9.9 at %, 10.0 at %, 10.1 at %, 10.2 at %, 10.3 at %, 10.4 at %, 10.5 at %, 10.6 at %, 10.7 at %, 10.8 at %, 10.9 at %, 11.0 at %, 11.1 at %, 11.2 at %, 11.3 at %, 11.4 at %, 11.5 at %, 11.6 at %, 11.7 at %, 11.8 at %, 11.9 at %, or 12.0 at %, 12.5 at %, 12.6 at %, 12.7 at %, 12.8 at %, 12.9 at %, 13.0 at %, 13.1 at %, 13.2 at %, 13.3 at %, 13.4 at %, 13.5 at %, 13.6 at %, 13.7 at %, 13.8 at %, 13.9 at %, 14.0 at %, and niobium may be present at one or more of the following atomic percentages: 0 at %, 1.5 at %, 1.6 at %, 1.7 at %, 1.8 at %, 1.9 at %, 2.0 at %, 2.1 at %, 2.2 at %, 2.3 at %, 2.4 at %, or 2.5 at %.

In one embodiment, the alloy composition may consist essentially of a minimum of five of the above listed elements. In another embodiment, the alloy composition may consist essentially of five to seven of the above listed elements. In a further embodiment, the alloy composition may consist essentially of iron, nickel, boron, silicon and one or more of the following: cobalt, chromium, carbon and niobium. In another embodiment, the alloy may composition consist essentially of iron, nickel, boron, silicon and chromium.

For example, the glass forming chemistries which may form the SGMM may include, consist of or consist essentially of iron present in the range of 49 at % to 65 at %, nickel present in the range of 14.5 at % to 16.5 at %, cobalt present in the range of 2.5 at % to 12 at %, boron present in the range of 12.5 at % to 16.5 at %, silicon present in the range of 0.4 at % to 8.0 at %, (e.g., 0.5 at % to 8.0 at %), carbon optionally present in the range of 2 at % to 5 at %, chromium optionally present in the range of 2.5 at % to 13.35 at %, and niobium optionally present in the range of 1.5 at % to 2.5 at %. For example, in one embodiment the alloy may include iron present in the range of 52 at % to 65 at%, nickel present in the range of 10 at % to 16.5 at %, boron present in the range of 13 at% to 15 at %, silicon present in the range of 0.4 at % to 0.5 at %, and chromium present in the range of 3 at % to 13.35 at %.

For example, in one embodiment, the alloy may include 53 at % to 62 at % iron, 15.5 at % to 16.5 at % nickel, optionally 4 at % to 10 at % cobalt, 12 at % to 16 at % boron, 4.5 at % to 4.6 at % carbon, and 0.4 at % to 0.5 at % silicon. In another embodiment, the alloy may include 51 at % to 65 at % iron, 16.5 at % nickel, optionally 3 at % to 12 at % cobalt, 15 at % to 16.5 at % boron, and 0.4 at % to 4 at % silicon. In a further embodiment, the alloy may include 49 at % to 61 at % iron, 14.5 at % to 16 at % nickel, 2.5 at % to 12 at % cobalt, 13 at % to 16 at % boron, 3 at % to 8 at % silicon, and 2.5 at % to 3 at % chromium. In yet a further embodiment, the alloy may include 57 at % to 60 at % iron, 14.5 at % to 15.5 at % nickel, 2.5 at % to 3 at % cobalt, 13 at % to 14 at % boron, 3.5 at % to 8 at % silicon, 2.5 at % to 3 at % chromium and optionally 2 at % niobium.

The alloys in ingot form may exhibit a density in the range of 7.5 grams per cubic centimeter ($g/cm^3$) to 7.8 $g/cm^3$, including all values and increments therein, such as 7.50, 7.51, 7.52, 7.53, 7.54, 7.55, 7.56, 7.57, 7.58, 7.59, 7.60, 7.61, 7.62, 7.63, 7.64, 7.65, 7.66, 7.67, 7.68, 7.69, 7.70, 7.71, 7.72, 7.73, 7.74, 7.75, 7.76, 7.77, 7.78, 7.79, 7.80.

The alloys may be processed by a number of processing techniques to yield thin product forms including ribbons, fibers, foils (relatively thin sheet), relatively thick sheet and microwires. Examples of processing techniques that may be configured to provide the SGMM structures herein and associated plasticity include but are not limited to melt-spinning/jet Casting, hyperquenching, Taylor-Ulitovsky wire casting, planar flow casting, and twin roll casting. Additional details of these manufacturing techniques, operating in a manner to provide the SGMM structures herein, are included below. Cooling rates may be in the range of $10^3$K/s to $10^6$ K/s, including all values and ranges therein, such as $10^4$K/s-$10^6$K/s, etc. In addition, the products may exhibit a thickness in the range of 0.001 mm to 3 mm, including all values and ranges therein. For example, the products may have a thickness in the range of 0.001 mm to 0.15 mm, 0.001 mm to 0.12 mm, 0.016 mm to 0.075 mm, etc.

In the melt-spinning process, a liquid melt may be ejected using gas pressure onto a rapidly moving copper wheel. Continuous or broken up lengths of ribbon may be produced. In some embodiments, the ribbon may be in the range of 1 to 2 mm wide and 0.015 to 0.15 mm thick, including all values and increments therein. The width and thickness may depend on the melt spun materials viscosity and surface tension and the wheel tangential velocity. Typical cooling rates in the melt-spinning process may be from ~$10^4$ to ~$10^6$ K/s, including all values and increments therein. Ribbons may generally be produced in a continuous fashion up to 25 m long using a laboratory scale system. Existing commercial systems used for magnetic materials may also be called jet casters.

Process parameters in one embodiment of melt spinning may include providing the liquid melt in a chamber, which is in an environment including air or an inert gas, such as helium, carbon dioxide, carbon dioxide and carbon monoxide mixtures, or carbon dioxide and argon mixtures. The chamber pressure may be in the range of 0.25 atm to 1 atm, including all values and increments therein. Further, the casting wheel tangential velocity may be in the range of 15 meters per second (m/s) to 30 m/s, including all values and increments therein. Resulting ejection pressures may be in the range of 100 to 300 mbar and resulting ejection temperatures may be in the range of 1000° C. to 1300° C., including all values and increments therein.

Hyperquenching may be understood as a relatively large scale commercial process that may be based on relatively continuous rapid solidification molten metal and used for fiber production. Molten metal may be consistently poured onto the moving surface of a rotating chill roll with a specifically designed groove pattern. Fibers may be solidified on the chill roll at lengths which can vary from a few mm's to a 100 mm, including all values and increments therein and thickness from 0.015 to 0.15 mm, including all values and increments therein. Typical cooling rates in the melt-spinning process may be from ~$10^4$ to ~$10^6$ K/s, including all values and increments therein.

An example of a process for producing relatively small diameter wire with a circular cross section is the Taylor-Ulitovsky process. In this wire making process, metal feedstock in the form of a powder, ingot, or wire/ribbon may be held in a glass tube, typically a borosilicate composition, which is closed at one end. This end of the tube may then be heated in order to soften the glass to a temperature at which the metal part is in liquid state while the glass may be softened yet not melted. The glass containing the liquid melt may then be drawn down to produce a fine glass capillary containing a metal core. At suitable drawing conditions, the molten metal fills the glass capillary and a microwire may be produced where the metal core is completely coated by a glass shell. The process may be continuous by continuously feeding the metal drop using powder or wire/ribbon with new alloy material. The method has been touted as a relatively low cost production method. The amount of glass used in the process may be balanced by the continuous feeding of the glass tube through the inductor zone, whereas the formation of the metallic core is restricted by the initial quantity of the master alloy droplet. The microstructure of a microwire (and hence, its properties) may depend mainly on the cooling rate, which can be controlled by a cooling mechanism when the metal-filled capillary enters into a stream of cooling liquid (water or oil) on its way to the receiving coil. Metal cores in the range of 1 to 120 μm with a glass coating which may be in the range of 2 to 20 μm in thickness, including all values and increments therein, may be produced by this method. Cooling rates may vary from $10^3$ to $10^6$ K/s, including all values and increments therein, in the process.

Planar flow casting may be understood as a relatively low cost and relatively high volume technique to produce wide ribbon in the form of continuous sheet and involves flowing a liquid melt at a close distance over a chill surface. Widths of thin foil/sheet up to 18.4" (215 mm), including all values and increments in the range of 10 mm to 215 mm, may be produced on a commercial scale with thickness in the range of 0.016 to 0.075 mm, including all values and increments therein, with cooling rates which may be in the range of ~$10^4$ to ~$10^6$ K/s, including all values and increments therein. After production of sheets, the individual sheets (from 5 to 50) can be warm pressed to roll bond the compacts into sheets. Sheets may also be cut, chopped, slit, and corrugated into other product and product forms.

In the twin roll casting process, a liquid melt is quenched between two rollers rotating in opposite directions. Solidification begins at first contact between the upper part of each of the rolls and the liquid melt. Two individual shells begin to form on each chill surface and, as the process continues, are subsequently brought together at the roll nip by the chill rolls to form one continuous sheet. By this approach, solidification occurs rapidly and direct melt thicknesses can be achieved much thinner than conventional melt processes and typically into the 1.5 to 3.0 mm range prior to any post processing steps such as hot rolling. The process is similar in many ways to planar flow casting with one of the main differences is that two chill rollers are used to produce sheet in twin roll casting rather than a single chill roller in planar flow casting. However, in the context of the sheet that may be produced herein, having the indicated SGMM structure, the thickness may be in the range of 0.5 to 5.0 mm.

In some embodiments, the glass forming alloys, upon formation, may exhibit glass to crystalline temperature ranges, which may exhibit one or more transition peaks. For example, the glass to crystalline onset to peak range may be 395° C. to 576° C., including all values and increments therein, when measured at 10° C./min. Primary onset glass transition temperatures may be in the range of 395° C. to 505° C. and secondary onset glass transition temperatures, when present, may be in the range of 460° C. to 541° C. Primary peak glass transition temperatures may be in the range of 419° C. to 521° C. and secondary onset glass transition temperatures, when present, may be in the range of 465° C. to 576° C. Further, the enthalpies of transformation may be in the range of ~21.4 J/g to ~115.3 J/g, including all values and increments therein. The properties may be obtained either by DSC or DTA when measure at a heating/cooling rate of 10° C./min.

The formed alloys may also exhibit complete bending on one or both sides of the formed alloys, when tested under the 180° bend test. That is, a ribbon or foil of the alloys described herein, having a thickness in the range of 20 μm to 85 μm, may be folded completely over in either direction. In addition, the formed alloys in ribbon form (as formed by melt spinning), may exhibit the following mechanical properties when tested at a strain rate of 0.001 $s^{-1}$. The ultimate tensile strength may be in the range of 2.30 GPa to 3.27 GPa, including all values and increments therein. The total elongation may be in the range of 2.27% to 4.78%, including all values and increments therein. When formed into a foil (as formed by planar flow casting) the alloys may exhibit an ultimate tensile strength in the range of 1.77 GPa to 3.13 GPa and a total elongation of 2.6% to 3.6%. In addition, the foils may exhibit an average microhardness in the range of 9.10 GPa to 9.21 GPa when tested under a 50 gram load.

The formed alloys in wire form (as formed by the Taylor-Ulitovsky Process), may exhibit the following mechanical properties when tested at a strain rate of 0.001 $s^{-1}$. The ultimate tensile strength may be in the range of 2.3 GPa to 5.8 GPa, including all values and increments therein. The total elongation may be in the range of 1.9% to 12.8%, including all values and increments therein. When formed into fibers (as formed by hyperquenching) the alloys may exhibit an ultimate tensile strength in the range of 0.62 GPa to 1.47 GPa and a total elongation of 0.67% to 2.56%.

Thus, in general, the alloy compositions may exhibit an ultimate tensile strength in the range of 0.62 GPa to 5.8 GPa, including all values and ranges therein, when measured at a strain rate of 0.001 $s^{-1}$. Furthermore, the alloy compositions may exhibit a total elongation in the range of 0.67% to 12.8%, including all values and ranges therein, when measured at a strain rate of 0.001 $s^{-1}$. The alloys may also exhibit a microhardness in the range of 9.10 GPa to 9.21 GPa, including all values and ranges therein when tested under a 50 gram load. In addition, the formed alloys as noted when produced as noted indicate a number of nanoscale features and exhibit the formation of the indicated SGMM structures and shear band densities or number per unit of measurement, such as linear meter. In some embodiments a metallic glass matrix may be present wherein the matrix may include semi-crystalline or crystalline clusters. The clusters may exhibit a size in the range of 1 to 15 nm in thickness and 2 to 60 nm in length. In other embodiments, the metallic glass matrix may include interconnected nanoscale phases range from several nm in length to 125 nanometers in length.

EXAMPLES

Sample Preparation

Using high purity and commercial purity elements, 15 g alloy feedstocks of the targeted alloys were weighed out according to the atomic ratios provided in Tables 1. The feedstock material was then placed into the copper hearth of an arc-melting system. The feedstock was arc-melted into an ingot using high purity argon as a shielding gas. The ingots were flipped several times and re-melted to ensure homogeneity. After mixing, the ingots were then cast in the form of a finger approximately 12 mm wide by 30 mm long and 8 mm thick. The resulting fingers were then placed in a melt-spinning chamber in a quartz crucible with a hole diameter of ~0.81 mm. The ingots were then processed by melting in different atmospheres and temperatures using RF induction and then ejected onto a 245 mm diameter copper wheel which was rotating at tangential velocities varying from 10.5 to 39 m/s.

TABLE 1

Chemical Composition of Alloys

| Alloy | Fe | Ni | Co | B | C | Si | Cr | Nb |
|---|---|---|---|---|---|---|---|---|
| 1 | 48.15 | 13.95 | 9.00 | 14.40 | 4.05 | 0.45 | — | — |
| 2 | 55.80 | 14.50 | 3.95 | 11.24 | 4.09 | 0.42 | — | — |
| 3 | 58.53 | 14.85 | 2.70 | 13.50 | — | 0.42 | — | — |
| 4 | 45.91 | 14.85 | 10.80 | 14.84 | — | 3.60 | — | — |
| 5 | 44.53 | 14.41 | 10.48 | 14.40 | — | 3.48 | 2.70 | — |
| 6 | 54.76 | 13.90 | 2.53 | 12.62 | — | 3.60 | 2.60 | — |
| 7 | 52.46 | 13.32 | 2.42 | 12.11 | — | 7.20 | 2.49 | — |
| 8 | 51.46 | 13.07 | 2.38 | 11.87 | 1.80 | 6.98 | 2.44 | — |
| 9 | 44.84 | 13.07 | 10.80 | 11.87 | — | 6.98 | 2.44 | — |
| 10 | 53.65 | 13.62 | 2.48 | 12.38 | — | 3.53 | 2.56 | 1.80 |
| 11 | 64.97 | 16.49 | — | 14.99 | — | 0.46 | 3.09 | — |
| 12 | 62.83 | 10.00 | — | 13.40 | — | 0.42 | 13.35 | — |

The alloys of Table 1 were melt-spun under various conditions. Representative melt-spinning parameters for each alloy are listed in Table 2, which resulted in the achievement of relatively significant levels of tensile ductility.

TABLE 2

Melt-Spinning Parameters of Alloys

| Alloy | Purity | Chamber gas | Pressure in chamber [atm] | Wheel Speed [m/s] | Ejection Pressure [mbar] | Ejection Temperature [° C.] |
|---|---|---|---|---|---|---|
| 1 | HP | He | 1/3 | 16 | 280 | 1200 |
| 2 | HP | Air | ⅓ | 30 | 280 | 1250 |
| 3 | HP | He | ⅓ | 10.5 | 280 | 1200 |
| 4 | CP | Norco 9 ($CO_2$/Ar) | ⅓ | 15 | 280 | 1225 |
| 5 | HP | He | ⅓ | 16 | 280 | 1250 |
| 6 | CP | Air | 1 | 25 | 280 | 1200 |
| 7 | CP | Air | ⅓ | 25 | 280 | 1300 |
| 8 | CP | $CO_2$ | ⅓ | 25 | 140 | 1300 |
| 9 | CP | $CO_2$ + CO | ⅓ | 25 | 280 | 1250 |
| 10 | CP | Air | ⅓ | 25 | 140 | 1200 |
| 11 | CP | CO2 | ⅓ | 25 | 280 | 1208 |
| 12 | CP | CO2 | ⅓ | 25 | 280 | 1276 |

The density of the alloys in ingot form was measured using the Archimedes method in a specifically constructed balance allowing for weighing in both air and distilled water. The density of the arc-melted 15 gram ingots for each alloy is tabulated in Table 3 and was found to vary from 7.56 g/cm$^3$ to 7.75 g/cm$^3$. Experimental results have revealed that the accuracy of this technique is +/−0.01 g/cm$^3$.

TABLE 3

Density of Alloys

| Alloy | Density (g/cm$^3$) |
|---|---|
| 1 | 7.73 |
| 2 | 7.75 |
| 3 | 7.75 |
| 4 | 7.70 |
| 5 | 7.71 |
| 6 | 7.70 |
| 7 | 7.56 |
| 8 | 7.58 |
| 9 | 7.64 |
| 10 | 7.71 |
| 11 | 7.73 |
| 12 | 7.66 |

Thermal analysis was performed on the as-solidified ribbon structure on a Perkin Elmer DTA-7 system with the DSC-7 option or a NETZSCH DSC404 F3 DSC. Differential thermal analysis (DTA) and differential scanning calorimetry (DSC) was performed at a heating rate of 10° C./minute with samples protected from oxidation through the use of flowing ultrahigh purity argon. In Table 4, the DSC data related to the glass to crystalline transformation is shown for each alloy listed in Table 1 and melt-spun at parameters specified in Table 2. As can be seen, all alloys exhibit glass to crystalline transformations verifying that the as-spun state contains relatively significant fractions of metallic glass, e.g. at a volume percent level of greater than or equal to 10%. The glass to crystalline transformation occurs in either one stage or two stages in the range of temperature from 395° C. to 576° C. and with enthalpies of transformation from −21.4 J/g to −115.3 J/g.

TABLE 4

DSC Data for Glass to Crystalline Transformations in Melt-Spun Ribbons

| Alloy | Glass | Peak #1 Onset (° C.) | Peak #1 Peak (° C.) | ΔH (−J/g) | Peak #2 Onset (° C.) | Peak #2 Peak (° C.) | ΔH (−J/g) |
|---|---|---|---|---|---|---|---|
| 1 | Yes | 466 | 469 | 115.3 | — | — | — |
| 2 | Yes | 439 | 450 | 30.2 | 477 | 483 | 65.3 |
| 3 | Yes | 395 | 419 | 21.4 | 460 | 465 | 55.1 |
| 4 | Yes | 485 | 492 | 43.2* | — | — | — |
| 5 | Yes | 484 | 492 | 51.1 | — | — | — |
| 6 | Yes | 457 | 463 | 23.0 | 501 | 509 | 33.8 |
| 7 | Yes | 505 | 520 | 114.0 | — | — | — |
| 8 | Yes | 499 | 521 | 102.4 | — | — | — |
| 9 | Yes | 486 | 496 | 35.1 | 517 | 531 | 49.4 |
| 10 | Yes | 469 | 480 | 40.7 | 541 | 576 | 53.3 |
| 11 | Yes | 402 | 417 | 52 | 451 | 472 | 69 |
| 12 | Yes | 433 | 448 | 53 | 481 | 501 | 76 |

at %, *Two overlapping peaks

The ability of the ribbons to bend completely flat indicates a ductile condition whereby relatively high strain can be obtained but not measured by traditional bend testing. When the ribbons are folded completely around themselves, they experience high strain which can be as high as 119.8% as derived from complex mechanics. During 180° bending (i.e. flat), four types of behavior can be observed; Type 1 Behavior—not bendable without breaking, Type 2 Behavior—bendable on one side with the side contacting the casting wheel facing outward (wheel side), Type 3 Behavior—bendable on one side with the side away from the casting wheel facing outward (free side), and Type 4 Behavior—bendable on both sides, either the side contacting the casting wheel or the side not contacting the casting wheel. In Table 5, a summary of the 180° bending results including the specific behavior type are shown for each alloy listed in Table 1 and melt-spun at parameters specified in Table 2. The thickness of melt-spun ribbons varies from 20 to 85 μm.

TABLE 5

Summary on Ribbon Thickness and Bending Behavior

| Alloy | Thickness (μm) | Bending Response Alloy | Behavior Type |
|---|---|---|---|
| 1 | 35-42 | Bendable on free side | 3 |
| 2 | 20-25 | Bendable on both side along entire length | 4 |
| 3 | 80-85 | Bendable on both side along entire length | 4 |
| 4 | 50-67 | Bendable on both side along entire length | 4 |
| 5 | 27-31 | Bendable on both side along entire length | 4 |
| 6 | 36-42 | Bendable on both side along entire length | 4 |
| 7 | 47-49 | Bendable on both side along entire length | 4 |
| 8 | 35-42 | Bendable on both side along entire length | 4 |
| 9 | 41-44 | Bendable on both side along entire length | 4 |
| 10 | 27-37 | Bendable on both side along entire length | 4 |
| 11 | 39-55 | Bendable on both side along entire length | 4 |
| 12 | 40-60 | Bendable on both side along entire length | 4 |

The mechanical properties of metallic ribbons were obtained at room temperature using microscale tensile testing. The testing was carried out in a commercial tensile stage made by Ernest Fullam Inc., which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gauge length. Before testing, the thickness and width of a ribbon tensile specimen was carefully measured at least three times at different locations in the gauge length. The average values were then recorded as gauge thickness and width, and used as input parameters for subsequent stress and strain calculation. The initial gauge length for tensile testing was set at ~7 to ~9 mm with the exact value determined after the ribbon was fixed, by accurately measuring the ribbon span between the front faces of the two gripping jaws. All tests were performed under displacement control, with a strain rate of ~0.001 $s^{-1}$. A summary of the tensile test results including total elongation, yield strength, ultimate tensile strength, and Young's Modulus are shown in Table 6 for each alloy listed in Table 1 and melt-spun at parameters specified in Table 2. Note that the results shown in Table 6 have been adjusted for machine compliance and have been measured at a gauge length of 9 mm. Also, note that each distinct alloy was measured in triplicate since occasional macrodefects arising from the melt-spinning process can lead to localized areas with reduced properties. As can be seen, the tensile strength values vary from 2.30 GPa to 3.27 GPa while the total elongation values vary from 2.27% to 4.78%. Young's Modulus value for the alloys was measured in a range from 66.4 to 188.5 GPa. Additionally, all alloys have demonstrated the ability to exhibit strain hardening like a crystalline metal.

TABLE 6

Summary on Tensile Properties of Melt-Spun Ribbons

| Alloy | Total Elongation (%) | Yield Strength (GPa) | UTS (GPa) | Young's Modulus (GPa) |
|---|---|---|---|---|
| 1 | 2.27 | 1.97 | 2.90 | 160.2 |
| | 3.11 | 2.08 | 3.24 | 113.4 |
| | 2.87 | 1.78 | 2.92 | 122.0 |
| 2 | 4.70 | 1.91 | 3.18 | 127.8 |
| | 2.57 | 1.56 | 2.56 | 133.0 |
| | 3.00 | 1.78 | 2.77 | 125.5 |
| 3 | 3.88 | 1.83 | 3.04 | 123.9 |
| | 3.70 | 1.80 | 2.92 | 125.1 |
| | 3.99 | 1.67 | 3.14 | 116.8 |
| 4 | 2.78 | 1.66 | 2.92 | 151.0 |
| | 3.00 | 1.67 | 2.57 | 156.2 |
| | 2.89 | 1.70 | 2.93 | 152.2 |
| 5 | 3.88 | 1.44 | 2.97 | 115.9 |
| | 4.62 | 1.44 | 3.16 | 114.9 |
| | 3.73 | 1.69 | 3.27 | 140.1 |
| 6 | 2.78 | 1.83 | 2.63 | 144.3 |
| | 2.78 | 1.81 | 2.67 | 140.0 |
| | 2.44 | 1.73 | 2.56 | 146.5 |
| 7 | 3.56 | 1.13 | 2.35 | 142.9 |
| | 2.78 | 1.58 | 2.38 | 150.2 |
| | 2.67 | 1.79 | 2.62 | 160.6 |
| 8 | 4.33 | 1.06 | 2.68 | 125.9 |
| | 3.56 | 1.18 | 2.68 | 162.0 |
| | 4.78 | 0.82 | 2.65 | 137.1 |
| 9 | 3.20 | 1.05 | 2.71 | 167.2 |
| | 3.20 | 1.04 | 2.59 | 159.8 |
| | 2.80 | 1.40 | 2.59 | 183.4 |
| 10 | 3.44 | 1.23 | 2.89 | 161.8 |
| | 3.00 | 1.55 | 2.95 | 188.5 |
| | 2.78 | 1.60 | 3.11 | 163.7 |
| 11 | 3.50 | 1.85 | 2.52 | 83.2 |
| | 3.06 | 2.06 | 2.56 | 92.4 |
| | 4.59 | 1.76 | 2.59 | 66.4 |
| 12 | 3.38 | 1.40 | 2.37 | 91.9 |
| | 3.24 | 1.45 | 2.30 | 88.8 |
| | 3.22 | 1.68 | 2.42 | 92.8 |

CASE EXAMPLES

Case Example 1

For commercial processing studies, the alloys listed in Table 1 were made up in commercial purity (up to 10 at % impurity) using various ferroadditive and other readily commercially available constituents chosen to minimize alloy cost. In Table 7, a summary of the alloys utilized for commercial production trials is presented. A description of the resulting commercial product forms including the physical dimensions and the total length produced is provided in Table 8. Further examples of the products for each alloy type are provided in FIGS. 1 through 12.

TABLE 7

Summary on Alloys Used For Commercial Production Trials

| Alloy Number | Demonstrated Production Approaches |
|---|---|
| Alloy 1 | Planar Flow Casting |
| Alloy 2 | Taylor-Ulitovsky Process |
| Alloy 3 | Taylor-Ulitovsky Process |
| Alloy 4 | Taylor-Ulitovsky, Planar Flow Casting |
| Alloy 5 | Taylor-Ulitovsky Process |
| Alloy 6 | Planar Flow Casting, Taylor-Ulitovsky Process |
| Alloy 7 | Taylor-Ulitovsky Process |
| Alloy 8 | Taylor-Ulitovsky Process, Planar Flow Casting, Hyperquenching Process |
| Alloy 9 | Planar Flow Casting |
| Alloy 11 | Planar Flow Casting |
| Alloy 12 | Planar Flow Casting |

TABLE 8

Summary on Commercial Products

| Alloy Number | Demonstrated Production Approaches | Product Form |
|---|---|---|
| Alloy 1 | Planar Flow Casting | Foil thickness: 25-28 μm<br>Foil width: 7.5 mm<br>Foil length: 100 m |
| Alloy 2 | Taylor-Ulitovsky Process | Total wire diameters: 34-61 μm<br>Metal core diameters: 21-35 μm<br>Glass thickness: 6-13 μm<br>Total Length: 0.4 km |
| Alloy 3 | Taylor-Ulitovsky Process | Total wire diameters: 22-74 μm<br>Metal core diameters: 11.2-45 μm<br>Glass thickness: 2.5-18 μm<br>Total Length: 4.6 km |
| Alloy 4 | Taylor-Ulitovsky Process | Total wire diameters: 5.5-181.8 μm<br>Metal core diameters: 3-161.6 μm<br>Glass thickness: 2.5-18 μm<br>Total Length: 219 km |
| Alloy 4 | Planar Flow Casting | Foil thickness: 20-22 μm<br>Foil width: 6.5 mm<br>Foil length: 100 m |
| Alloy 5 | Taylor-Ulitovsky Process | Total wire diameters: 31.6-141.1 μm<br>Metal core diameters: 15.1-74.2 μm<br>Glass thickness: 7.7-34.2 μm<br>Total Length: 1.4 km |
| Alloy 6 | Planar Flow Casting | Foil thickness: 24-30 μm<br>Foil width: 7.4-7.6 mm<br>Foil length: 300 m |
| Alloy 7 | Taylor-Ulitovsky | Total wire diameters: 24-110.2 μm<br>Metal core diameters: 13.2-67.0 μm<br>Glass thickness: 4.3-27.3 μm<br>Total Length: 10.4 km |
| Alloy 8 | Taylor-Ulitovksy | Total wire diameters: 32.4-43 μm<br>Metal core diameters: 14-30 μm<br>Glass thickness: 3.6-11 μm<br>Total Length: 12.4 km |

TABLE 8-continued

| Summary on Commercial Products | | |
|---|---|---|
| Alloy Number | Demonstrated Production Approaches | Product Form |
| Alloy 8 | Planar Flow Casting | Foil thickness: 22-24 μm<br>Foil width: 7.5 mm<br>Foil length: 100 m |
| Alloy 8 | Hyperquenching Process | Fiber width: 1.4-2.3 mm<br>Fiber length: : 25-30 mm<br>Fiber thickness: 37-53 μm<br>Total amount: 280 kg |
| Alloy 9 | Planar Flow Casting | Foil thickness: 24-32 μm<br>Foil width: 7.5-8.0 mm<br>Foil length: 300 m |
| Alloy 11 | Planar Flow Casting | Foil thickness: 24-49 μm<br>Foil width: 17-50 mm<br>Foil length: >300 m<br>Foil mass: >100 kg |
| Alloy 12 | Planar Flow Casting | Foil thickness: 32-36 μm<br>Foil width: 50 mm<br>Foil length: >300 m<br>Foil mass: >9 kg |

Case Example #2

Using the Taylor-Ulitovsky process, a range of wire was produced using a wide variety of parameter variations including variations in the liquid metal droplet position inside the inductor, melt temperature superheat, glass feed velocity, vacuum pressure force, spool winding velocity, glass feedstock type etc. A summary of parameters of produced microwires is given in Table 8. The metal core diameter varied from 3 to 162 μm while the total wire diameter (i.e. with glass coating) varied from 5 to 182 μm. The length of the wire produced varied from 28 to 9000 m depending on the stability of the process conditions.

The mechanical properties of microwires were measured at room temperature using microscale tensile testing. The testing was carried out in a commercial tensile stage made by Ernest Fullam, Inc., which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gauge length. Before testing, the diameter of each wire was carefully measured at least three times at different locations in the gauge length. The average value was then recorded as gauge diameter and used as input for subsequent stress and strain calculation. All tests were performed under displacement control, with a strain rate of ~0.001 $s^{-1}$. A summary of the tensile test results including the wire diameter (metal core and total), measured gauge length, total elongation, applied load (preloading and peak loading) and measure strength (yield stress and ultimate tensile strength) are given in Tables 9 through 13. As can be seen, the tensile strength values vary from 2.3 GPa to 5.8 GPa while the total elongation values vary from 1.9% to 12.8%.

TABLE 9

Tensile Properties of Alloy 2 Microwires

| Diameters (mm) | | Gauge Length | Elongation | | Load (N) | | Strength (GPa) | |
|---|---|---|---|---|---|---|---|---|
| Outside | Core | (mm) | (mm) | (%) | Pre | Peak | Yield | UTS |
| 0.051 | 0.03 | 26.0 | 1.31 | 5.07 | N/A | 2.919 | 1.36 | 4.13 |
| 0.051 | 0.027 | 28.0 | 1.75 | 6.25 | N/A | 2.293 | 1.39 | 4.01 |
| 0.048 | 0.025 | 31.0 | 1.79 | 5.77 | N/A | 2.006 | N/A | 4.09 |
| 0.048 | 0.022 | 11.8 | 0.66 | 5.77 | 0.145 | 1.315 | N/A | 3.84 |
| 0.048 | 0.022 | 12.1 | 1.00 | 8.28 | 0.107 | 1.344 | N/A | 3.82 |
| 0.048 | 0.022 | 19.8 | 0.75 | 3.79 | 0.088 | 0.940 | N/A | 2.71 |
| 0.051 | 0.031 | 14.5 | 1.29 | 8.90 | 0.107 | 2.872 | N/A | 3.95 |
| 0.048 | 0.028 | 14.2 | 1.20 | 8.43 | 0.443 | 2.210 | N/A | 4.31 |
| 0.048 | 0.028 | 16.1 | 1.71 | 10.62 | 0.254 | 2.267 | N/A | 4.10 |
| 0.061 | 0.035 | 40.0 | 0.77 | 1.93 | 0.039 | 3.214 | 1.24 | 3.38 |
| 0.053 | 0.035 | 40.0 | 1.27 | 3.18 | 0.046 | 3.246 | 1.46 | 3.42 |
| 0.034 | 0.022 | 26.0 | 1.46 | 5.62 | 0.063 | 1.769 | N/A | 4.82 |
| 0.034 | 0.022 | 24.4 | 2.16 | 8.85 | 0.041 | 1.719 | N/A | 4.63 |
| 0.038 | 0.021 | 14.0 | 0.49 | 3.50 | 0.023 | 1.079 | N/A | 3.18 |
| 0.038 | 0.021 | 12.1 | 0.71 | 5.87 | 0.069 | 1.025 | N/A | 3.16 |
| 0.038 | 0.021 | 10.0 | 0.63 | 6.30 | 0.092 | 0.965 | N/A | 3.05 |
| 0.038 | 0.021 | 16.8 | 0.57 | 3.39 | 0.061 | 1.162 | N/A | 3.53 |
| 0.038 | 0.021 | 10.9 | 1.00 | 9.17 | 0.129 | 0.966 | N/A | 3.16 |
| 0.038 | 0.021 | 12.0 | 0.74 | 6.17 | 0.03 | 1.166 | N/A | 3.45 |

TABLE 10

Tensile Properties of Alloy 3 Microwires

| Diameters (mm) | | Gauge Length | Elongation | | Load (N) | | Strength (GPa) | |
|---|---|---|---|---|---|---|---|---|
| Outside | Core | (mm) | (mm) | (%) | Pre | Peak | Yield | UTS |
| 0.051 | 0.021 | 20.00 | N/A | N/A | N/A | 1.456 | N/A | 4.21 |
| 0.051 | 0.021 | 20.00 | 0.67 | 3.45 | N/A | 0.992 | 1.28 | 2.87 |
| 0.054 | 0.033 | 25.00 | 2.50 | 10.05 | N/A | 4.538 | 2.14 | 4.54 |
| 0.053 | 0.033 | 30.00 | 1.81 | 6.04 | N/A | 4.389 | N/A | 5.82 |
| 0.043 | 0.013 | 11.41 | 0.95 | 8.33 | 0.080 | 0.5 | 1.59 | 4.37 |
| 0.043 | 0.013 | 15.71 | 0.84 | 5.35 | 0.031 | 0.457 | 1.82 | 3.68 |
| 0.043 | 0.013 | 11.47 | 0.74 | 6.45 | 0.035 | 0.526 | N/A | 4.23 |
| 0.057 | 0.037 | 12.11 | 1.55 | 12.80 | 0.205 | 4.454 | 1.67 | 4.34 |
| 0.057 | 0.037 | 11.22 | 1.38 | 12.3 | 0.546 | 4.287 | 1.26 | 4.50 |
| 0.057 | 0.037 | 12.93 | 1.00 | 7.73 | 1.341 | 3.282 | 1.95 | 4.30 |
| 0.054 | 0.032 | 10.33 | 0.80 | 7.74 | 0.176 | 3.56 | 1.96 | 4.65 |
| 0.054 | 0.032 | 11.53 | 0.57 | 4.94 | 0.817 | 3.623 | 2.69 | 5.52 |
| 0.054 | 0.032 | 10.31 | 0.82 | 7.95 | 0.101 | 4.212 | 2.35 | 5.37 |
| 0.044 | 0.025 | 11.53 | 0.55 | 4.77 | 0.031 | 1.418 | 1.96 | 2.95 |

TABLE 11

Tensile Properties of Alloy 4 Microwires

| Diameters (mm) | | Gauge Length | Elongation | | Load (N) | | Strength (GPa) | |
|---|---|---|---|---|---|---|---|---|
| Outside | Core | (mm) | (mm) | (%) | Pre | Peak | Yield | UTS |
| 0.056 | 0.031 | 22.00 | 0.63 | 2.86 | N/A | 2.978 | 1.61 | 3.95 |
| 0.078 | 0.033 | 26.00 | 0.77 | 2.96 | N/A | 3.344 | 1.19 | 3.91 |
| 0.061 | 0.038 | 32.00 | 1.42 | 4.44 | N/A | 4.760 | N/A | 4.20 |
| 0.061 | 0.038 | 28.00 | 1.06 | 3.79 | N/A | 5.050 | N/A | 4.45 |
| 0.066 | 0.042 | 11.34 | 0.56 | 4.94 | 0.154 | 4.769 | 0.89 | 3.56 |
| 0.066 | 0.042 | 11.43 | 0.74 | 6.47 | 0.198 | 4.490 | 1.20 | 3.39 |
| 0.066 | 0.042 | 12.60 | 0.59 | 4.68 | 0.241 | 4.577 | 1.31 | 3.48 |
| 0.066 | 0.042 | 18.10 | 0.70 | 3.87 | 0.224 | 4.429 | 1.03 | 3.36 |
| 0.057 | 0.033 | 11.46 | 0.61 | 5.32 | 0.855 | 2.702 | 1.71 | 4.16 |
| 0.057 | 0.033 | 12.38 | 1.05 | 8.48 | 0.268 | 3.417 | 1.20 | 4.31 |
| 0.057 | 0.033 | 12.45 | 0.95 | 7.63 | 0.153 | 3.338 | 1.48 | 4.08 |
| 0.057 | 0.033 | 20.31 | 0.90 | 4.43 | 0.198 | 3.192 | 2.24 | 3.97 |
| 0.033 | 0.014 | 11.32 | 0.74 | 6.54 | 0.042 | 0.597 | 2.54 | 4.15 |
| 0.033 | 0.014 | 12.11 | 0.66 | 5.45 | 0.000 | 0.466 | 2.23 | 3.03 |
| 0.033 | 0.014 | 12.62 | 0.52 | 4.12 | 0.023 | 0.711 | 2.23 | 4.77 |

TABLE 11-continued

| Tensile Properties of Alloy 4 Microwires | | | | | | | | |
|---|---|---|---|---|---|---|---|---|
| Diameters (mm) | | Gauge Length | Elongation | | Load (N) | | Strength (GPa) | |
| Outside | Core | (mm) | (mm) | (%) | Pre | Peak | Yield | UTS |
| 0.033 | 0.014 | 13.14 | 0.61 | 4.64 | 0.025 | 0.710 | 2.45 | 4.78 |
| 0.042 | 0.026 | 13.35 | 0.74 | 5.54 | 0.161 | 1.808 | 1.90 | 3.71 |
| 0.042 | 0.026 | 11.54 | 0.83 | 7.19 | 0.117 | 1.957 | 1.57 | 3.91 |
| 0.042 | 0.026 | 12.42 | 0.77 | 6.20 | 0.185 | 1.863 | 2.46 | 3.86 |
| 0.069 | 0.044 | 12.08 | 0.55 | 4.55 | 0.201 | 4.771 | 2.46 | 3.27 |
| 0.069 | 0.044 | 12.34 | 0.48 | 3.89 | 0.158 | 4.738 | 1.56 | 3.22 |
| 0.069 | 0.044 | 19.31 | 0.74 | 3.83 | 0.657 | 4.428 | 1.99 | 3.35 |
| 0.069 | 0.044 | 20.99 | 0.47 | 2.24 | 0.241 | 3.279 | 0.71 | 2.32 |

TABLE 12

| Tensile Properties of Alloy 5 Microwires | | | | | | | |
|---|---|---|---|---|---|---|---|
| Diameters (mm) | | Gauge Length | Elongation | | Failure | Strength (GPa) | |
| Outside | Core | (mm) | (mm) | (%) | Load (N) | Yield | UTS |
| 0.125 | 0.069 | 24.99 | 0.62 | 2.48 | 9.89 | 1.47 | 2.65 |
| 0.115 | 0.069 | 12.04 | 0.52 | 4.32 | 10.91 | 1.41 | 2.92 |
| 0.118 | 0.068 | 12.13 | 0.61 | 5.03 | 9.35 | 1.73 | 2.58 |
| 0.127 | 0.068 | 12.71 | 0.46 | 3.62 | 11.63 | 1.69 | 3.20 |
| 0.124 | 0.067 | 15.17 | 0.51 | 3.36 | 11.37 | 1.23 | 3.23 |
| 0.113 | 0.065 | 12.27 | 0.47 | 3.83 | 10.39 | 0.88 | 3.13 |
| 0.125 | 0.063 | 17.73 | 0.58 | 3.27 | 9.66 | 2.22 | 3.10 |
| 0.117 | 0.068 | 12.40 | 0.36 | 2.90 | 10.92 | 2.89 | 3.01 |
| 0.129 | 0.066 | 11.48 | 0.36 | 3.14 | 11.95 | 3.38 | 3.50 |
| 0.123 | 0.064 | 11.42 | 0.36 | 3.15 | 10.33 | 2.30 | 3.21 |
| 0.119 | 0.063 | 21.54 | 1.26 | 5.85 | 9.08 | 0.82 | 2.92 |
| 0.105 | 0.063 | 35.39 | 2.01 | 5.68 | 9.69 | 1.95 | 3.11 |
| 0.125 | 0.044 | 18.35 | 0.41 | 2.23 | 4.86 | 1.36 | 3.20 |
| 0.115 | 0.044 | 17.34 | 0.49 | 2.83 | 5.09 | 1.24 | 3.35 |
| 0.115 | 0.043 | 12.77 | 0.40 | 3.13 | 4.91 | 1.38 | 3.38 |
| 0.115 | 0.043 | 13.10 | 0.40 | 3.05 | 5.10 | 1.25 | 3.51 |
| 0.076 | 0.027 | 10.23 | 0.26 | 2.54 | 2.31 | 1.58 | 4.04 |
| 0.073 | 0.029 | 9.83 | 0.39 | 3.97 | 2.65 | 2.12 | 4.02 |
| 0.073 | 0.029 | 13.50 | 0.44 | 3.26 | 2.23 | 1.90 | 3.38 |
| 0.036 | 0.013 | 14.20 | 0.70 | 4.93 | 0.49 | 2.15 | 3.69 |
| 0.036 | 0.013 | 11.56 | 0.80 | 6.92 | 0.50 | 2.68 | 3.75 |
| 0.036 | 0.013 | 12.36 | 0.73 | 5.91 | 0.54 | 1.81 | 4.08 |
| 0.036 | 0.013 | 10.12 | 0.94 | 9.29 | 0.52 | 1.91 | 3.93 |
| 0.036 | 0.013 | 11.02 | 0.41 | 3.72 | 0.59 | 3.28 | 4.47 |

TABLE 13

| Tensile Properties of Alloy 7 Microwires | | | | | | | |
|---|---|---|---|---|---|---|---|
| Diameters (mm) | | Gauge Length | Elongation | | Failure | Strength (GPa) | |
| Outside | Core | (mm) | (mm) | (%) | Load (N) | Yield | UTS |
| 0.081 | 0.053 | 9.00 | 0.45 | 5.0 | 8.6 | 2.13 | 3.88 |
| 0.075 | 0.054 | 9.00 | 0.41 | 4.6 | 8.6 | 1.52 | 3.75 |
| 0.076 | 0.053 | 9.00 | 0.34 | 3.8 | 7.8 | 1.51 | 3.53 |
| 0.081 | 0.057 | 13.25 | 0.36 | 2.7 | 7.4 | 1.21 | 2.89 |
| 0.077 | 0.057 | 12.57 | 0.35 | 2.8 | 7.6 | 1.33 | 2.98 |
| 0.069 | 0.056 | 12.21 | 0.38 | 3.1 | 7.3 | 1.79 | 2.95 |
| 0.075 | 0.037 | 13.88 | 0.33 | 2.4 | 5.9 | 2.57 | 3.47 |
| 0.075 | 0.038 | 12.42 | 0.36 | 2.9 | 6.5 | 2.40 | 3.76 |
| 0.075 | 0.037 | 11.14 | 0.37 | 3.3 | 7.1 | 3.83 | 4.59 |

Case Example #3

Figure 13:
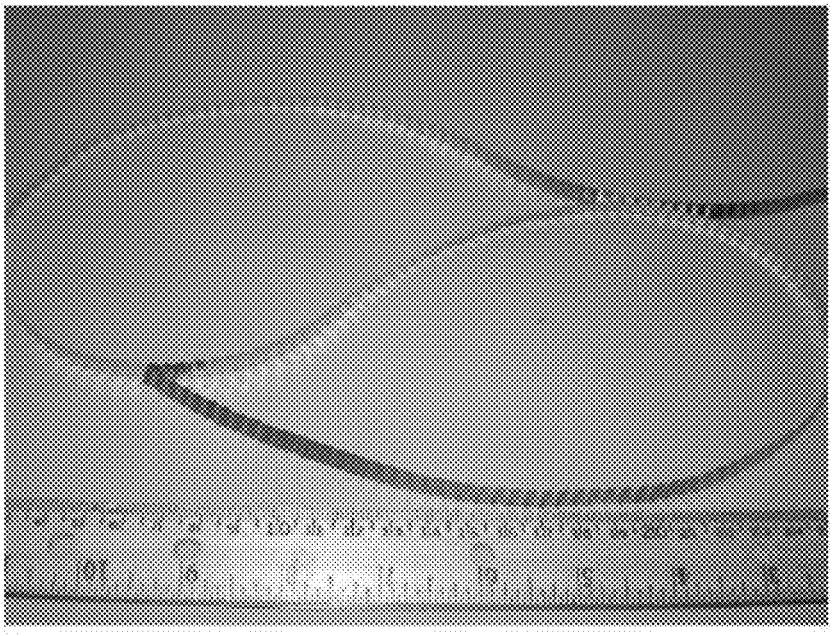
FIG. 13 illustrates an image of a corrugated foil from Alloy 6.

Using the Planar Flow Casting process, foils from Alloy 6, Alloy 8, Alloy 9, Alloy 11, and Alloy 12 were produced. The foil thickness varied from 22 to 49 μm, foil width varied from 6.5 to 50 mm and the length of the foil produced was ~100 m to greater than 1 km per run. Bend ability of foils was estimated by corrugation method on 1 m long continuous foil using a custom-built corrugation machine. An image of the foil after corrugation is presented in FIG. 13. All five alloys have demonstrated Type 4 bending behavior with 0 breaks during corrugation deformation (Table 14).

TABLE 14

| Results on Bend Ability Testing of Foils | | |
|---|---|---|
| Alloy | Bend ability | Breaks per 1 m |
| 6 | Type 4 | 0 |
| 8 | Type 4 | 0 |
| 9 | Type 4 | 0 |
| 11 | Type 4 | 0 |
| 12 | Type 4 | 0 |

The mechanical properties of foils were estimated by microhardness measurement and tensile testing. Microhardness testing was performed under a load of 50 g using a M400H1 microhardness tester manufactured by Leco Corporation. Summary of microhardness data is presented in Table 15. As it can be seen, all three alloys have shown average microhardness values in a range from 9.10 to 9.21 GPa. Using a well established relationship where the tensile strength of a material is ~⅓ of its hardness, the strength level of foil material can be estimated. Expected strength value for all three alloys in foil form is at least 3 GPa.

TABLE 15

| Microhardness of Foil Products (GPa) | | | |
|---|---|---|---|
| # | Alloy 6 | Alloy 8 | Alloy 9 |
| 1 | 9.12 | 9.02 | 9.20 |
| 2 | 9.14 | 9.31 | 9.03 |
| 3 | 9.21 | 9.09 | 9.12 |
| 4 | 8.97 | 9.32 | 9.20 |
| 5 | 9.05 | 9.33 | 9.10 |
| Average | 9.10 | 9.21 | 9.13 |

Tensile properties of the foils were measured at room temperature using microscale tensile testing. The testing was carried out in a commercial tensile stage made by Ernest Fullam, Inc., which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gauge length. Dogbone specimens with gauge length of 9 mm and gauge width of 2 mm were cut by EDM. Before testing, the geometrical parameters of each specimen were carefully measured at least three times at different locations in the gauge length. The average values were then recorded including gauge length, thickness and width and used as input for subsequent stress and strain calculation. All tests were performed under displacement control with a strain rate of ~0.001 $s^{-1}$. A summary of the tensile test results including values of the foil thickness, width, gauge length, total elongation, breaking load and measure strength (yield stress and ultimate tensile strength) are given in Table 16. As can be seen, the tensile strength values vary from 1.77 GPa to 3.13 GPa, the total elongation values vary from 2.6% to 3.6%. The scattering in measured strength values found is believed to be a result of the macroscale defects in commercially produced foils as a result of non-optimized process parameters.

TABLE 16

Tensile Properties of Foil Products

| Alloy | Specimen Size Thickness | Width | Gauge length | Elongation [mm] | [%] | Breaking Load [N] | Strength [GPa] Yield | UTS |
|---|---|---|---|---|---|---|---|---|
| Alloy 6 | 0.024 | 2.58 | 10.00 | 0.27 | 2.70 | 124.4 | 1.73 | 2.01 |
| | 0.024 | 2.58 | 10.00 | 0.28 | 2.80 | 122.3 | 1.02 | 1.98 |
| | 0.024 | 2.58 | 10.00 | 0.30 | 3.00 | 131.9 | 1.36 | 2.13 |
| | 0.024 | 2.58 | 10.00 | 0.36 | 3.60 | 141.1 | 1.30 | 2.28 |
| Alloy 8 | 0.023 | 2.58 | 10.00 | 0.26 | 2.60 | 105.0 | 1.07 | 1.77 |
| | 0.023 | 2.58 | 10.00 | 0.28 | 2.80 | 113.3 | 1.37 | 1.91 |
| | 0.023 | 2.58 | 10.00 | 0.27 | 2.70 | 107.2 | 1.06 | 1.81 |
| | 0.023 | 2.58 | 10.00 | 0.26 | 2.60 | 107.0 | 1.11 | 1.80 |
| Alloy 9 | 0.250 | 2.58 | 10.00 | 0.30 | 2.98 | 89.1 | 1.14 | 1.84 |
| | 0.026 | 2.61 | 10.00 | 0.35 | 3.50 | 99.5 | 1.47 | 2.87 |
| | 0.028 | 2.58 | 10.00 | 0.33 | 3.30 | 121.5 | 1.68 | 3.13 |
| Alloy 11 | 1.14 | 0.041 | 9 | 0.308 | 3.42 | 136.02 | 1.999 | 2.91 |
| | 1.35 | 0.04 | 9 | 0.323 | 3.59 | 154.21 | 1.714 | 2.86 |
| | 1.42 | 0.041 | 9 | 0.322 | 3.58 | 164.02 | 1.761 | 2.82 |
| Alloy 12 | 1.6 | 0.036 | 9 | 0.247 | 2.74 | 127.85 | 1.432 | 2.24 |
| | 1.57 | 0.036 | 9 | 0.262 | 2.91 | 130.47 | 1.609 | 2.33 |
| | 1.44 | 0.036 | 9 | 0.253 | 2.81 | 119.89 | 1.595 | 2.33 |

Case Example #4

Figure 14:
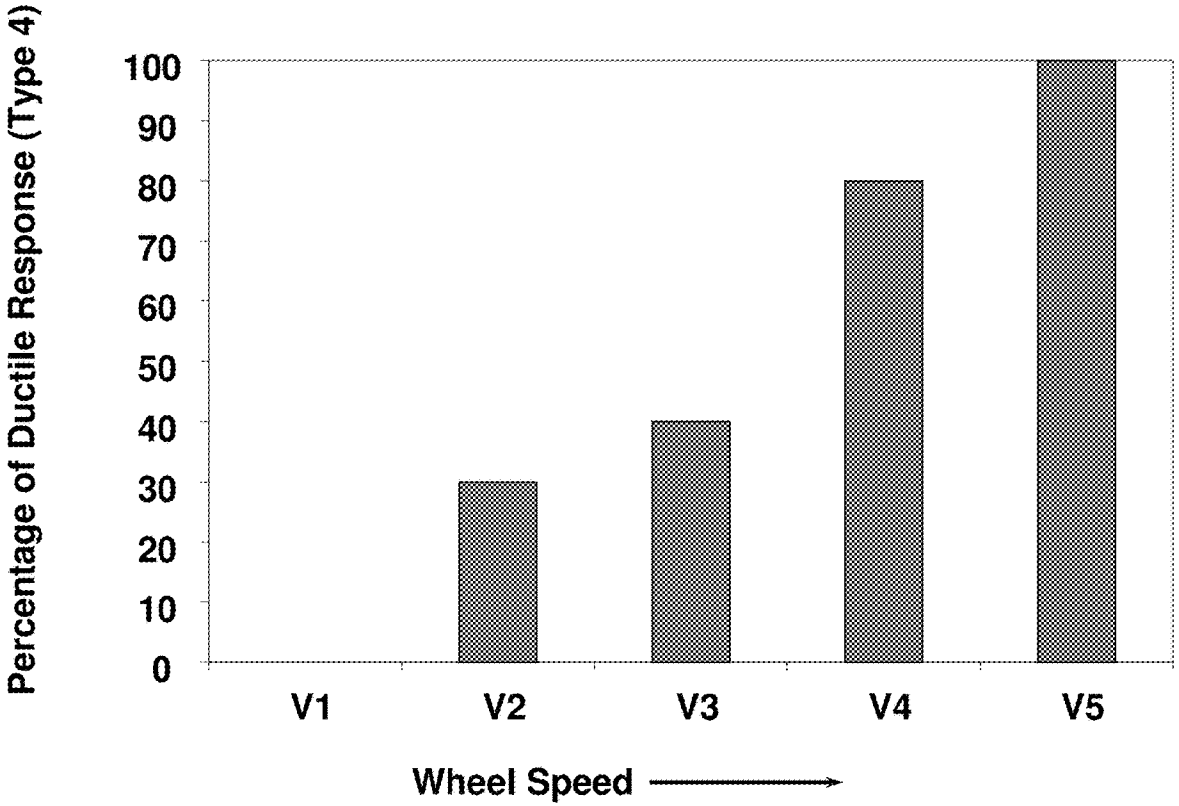
FIG. 14 illustrates bendability of fibers produced from Alloy 8 by the hyperquenching process as a function of wheel speed optimization.

Using the hyperquenching process, fibers from Alloy 8 were produced. The fiber thickness varied from 37 to 53 μm, with a fiber width from 1.4 to 2.3 mm and lengths from 25 to 30 mm. The ability of the fibers to bend completely flat indicates a ductile condition whereby high strain can be obtained but not measured by traditional bend testing. When the fibers are folded completely around themselves, they experience high strain which can be as high as 119.8% as derived from complex mechanics. During 180° bending (i.e. flat) of fibers produced at different conditions, four types of behavior were observed; Type 1 Behavior—not bendable without breaking, Type 2 Behavior—bendable on one side with wheel side out (wheel side), Type 3 Behavior—bendable on one side with free side out (free side), and Type 4 Behavior—bendable on both sides. In FIG. 14 a summary of the 180° bending results as a function of wheel speed during the hyperquenching process is presented.

Tensile properties of the fibers that exhibited 100% bendability were measured at room temperature using microscale tensile testing. The testing was carried out in a commercial tensile stage made by Ernest Fullam, Inc., which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gauge length. Before testing, the geometrical parameters of each specimen were carefully measured at least three times at different locations in the gauge length. The average values were then recorded as gauge length, thickness, and width and used as input for subsequent stress and strain calculation. All tests were performed under displacement control, with a strain rate of ~0.001 $s^{-1}$. A summary of the tensile test results including values of the fiber thickness, width, gauge length, total elongation, breaking load and measure strength (yield stress and ultimate tensile strength) is given in Table 17. The tensile strength values of commercially produced fibers vary from 0.62 GPa to 1.47 GPa and the total elongation values vary from 0.67% to 2.56%.

TABLE 17

Tensile Property of Alloy 8 Fiber Products

| Gauge Dimensions (mm) W | t | l | Elongation (%) Tot | Elastic | Plastic | Break Load (N) | Strength (GPa) Yield | UTS |
|---|---|---|---|---|---|---|---|---|
| 2.01 | 0.042 | 9.00 | 0.67 | 0.67 | 0.00 | 61.4 | 0.73 | 0.73 |
| 2.11 | 0.043 | 9.00 | 1.56 | 1.11 | 0.44 | 69.3 | 0.52 | 0.76 |
| 1.85 | 0.039 | 9.00 | 1.89 | 1.11 | 0.78 | 105.9 | 0.82 | 1.47 |
| 1.81 | 0.041 | 9.00 | 1.89 | 1.89 | 0.00 | 73.1 | 0.83 | 0.99 |
| 2.01 | 0.039 | 9.00 | 2.56 | 1.11 | 1.44 | 102.5 | 0.69 | 1.31 |
| 1.9 | 0.041 | 9.00 | 1.89 | 1.11 | 0.78 | 90.6 | 0.87 | 1.16 |
| 2.01 | 0.039 | 9.00 | 1.22 | 1.11 | 0.11 | 70.3 | 0.89 | 0.90 |
| 2.21 | 0.037 | 9.00 | 1.11 | 0.56 | 0.56 | 62.8 | 0.46 | 0.77 |
| 1.84 | 0.043 | 9.00 | 2.00 | 1.22 | 0.78 | 77.8 | 0.64 | 0.98 |
| 1.97 | 0.04 | 9.00 | 2.33 | 1.22 | 1.11 | 103.2 | 0.74 | 1.31 |
| 1.61 | 0.037 | 9.00 | 2.00 | 1.11 | 0.89 | 77.7 | 0.83 | 1.30 |
| 2.25 | 0.044 | 9.00 | 1.00 | 0.89 | 0.11 | 67.2 | 0.54 | 0.68 |
| 1.86 | 0.039 | 9.00 | 2.22 | 1.56 | 0.67 | 85.0 | 0.77 | 1.17 |
| 2.08 | 0.046 | 9.00 | 1.33 | 1.33 | 0.00 | 75.6 | 0.69 | 0.79 |
| 2.04 | 0.044 | 9.00 | 2.00 | 1.33 | 0.67 | 82.98 | 0.68 | 0.92 |
| 1.53 | 0.039 | 9.00 | 0.78 | 0.56 | 0.22 | 40.7 | 0.54 | 0.68 |
| 2.15 | 0.053 | 9.00 | 1.22 | 1.11 | 0.11 | 78.6 | 0.56 | 0.69 |
| 1.97 | 0.042 | 9.00 | 1.44 | 1.22 | 0.22 | 68.6 | 0.60 | 0.83 |
| 1.66 | 0.045 | 9.00 | 1.44 | 1.33 | 0.11 | 46.5 | 0.61 | 0.62 |
| 1.41 | 0.038 | 9.00 | 1.89 | 1.56 | 0.33 | 45.5 | 0.75 | 0.85 |
| 1.95 | 0.049 | 9.00 | 1.33 | 1.11 | 0.22 | 72.5 | 0.55 | 0.76 |
| 1.67 | 0.041 | 9.00 | 1.56 | 1.11 | 0.44 | 73.9 | 0.75 | 1.08 |
| 1.64 | 0.043 | 9.00 | 2.11 | 1.56 | 0.56 | 69.2 | 0.74 | 0.98 |
| 1.74 | 0.041 | 9.00 | 1.89 | 1.56 | 0.33 | 53.8 | 0.67 | 0.76 |

Figure 15B:
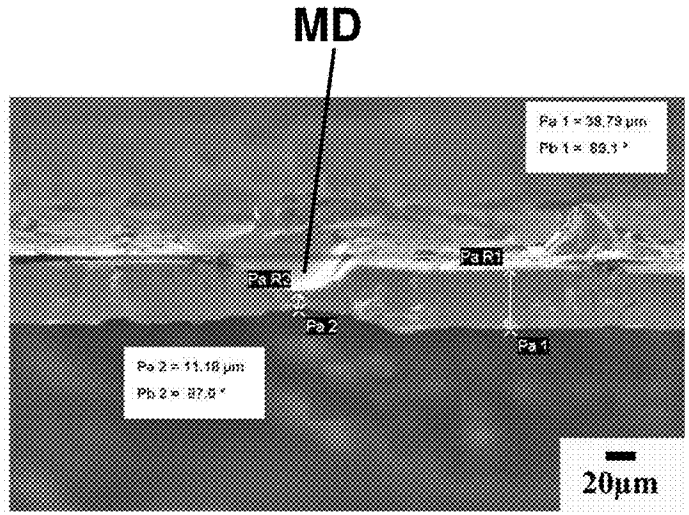
Figure 15A:
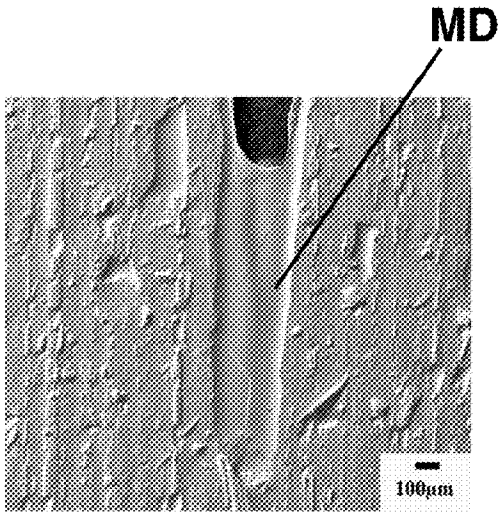

The tensile property values of the commercially produced fibers are lower than that for laboratory produced ribbons from the same alloy (Table 6). The main reason for tensile property deviations appears to be due to a large degree of macrodefects (MD) in commercially produced fiber that can be clearly seen in FIGS. 15*a* and 15*b*. Formation of these macrodefects appears to be a result of non-optimized hyperquenching process parameters at the initial commercial trial and can be eliminated by further process optimization. As can be seen in FIG. 15*b*, the cross sectional area is greatly reduced from the average value measured with a micrometer, which leads to anomalously low tensile strength values.

Case Example #5

Using high purity elements, 15 g alloy feedstocks of the Alloy 1, Alloy 4, and Alloy 8 were weighed out according to the atomic ratios provided in Table 1. The feedstock material was then placed into the copper hearth of an arc-melting system. The feedstock was arc-melted into an ingot using high purity argon as a shielding gas. The ingot was flipped and re-melted several times to ensure composition homogeneity. After mixing, the ingot was then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in a using RF induction and then ejected onto a 245 mm diameter copper wheel. The melt-spinning parameters are provided in Table 2.

Figure 16B:
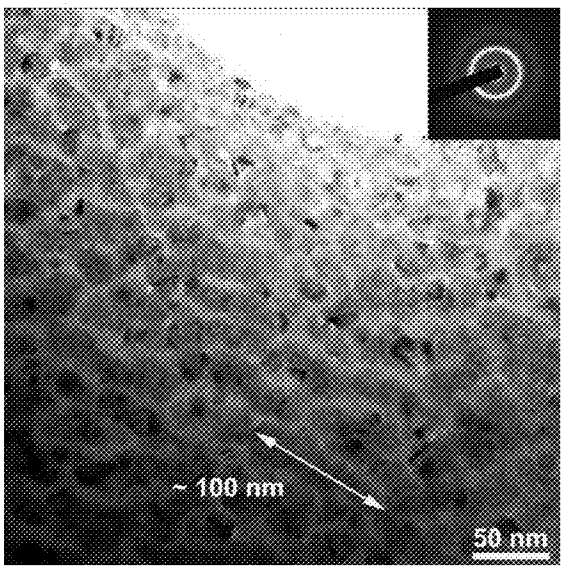
Figure 16A:
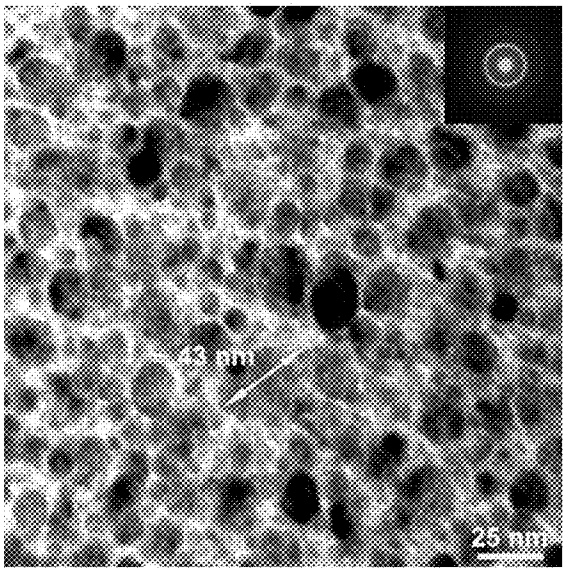
Figure 16C:
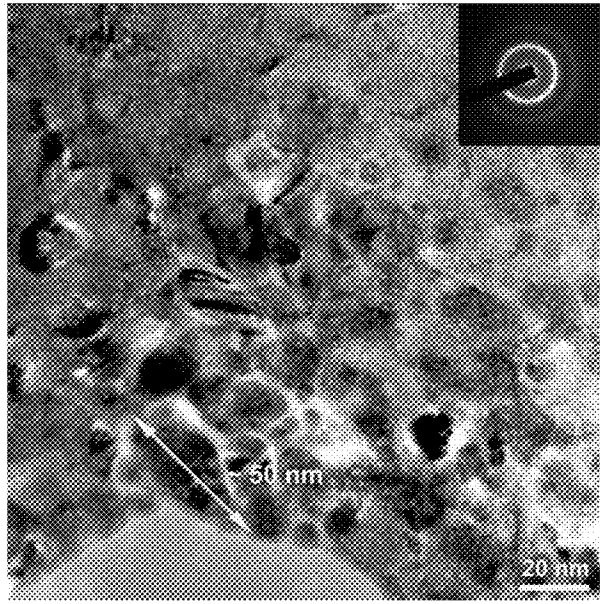

To examine the nanoscale structures in the melt-spinning ribbons, TEM foils were prepared using mechanical grinding to less than 10 μm followed by chemo-mechanical polishing. They were then ion milled until perforation using a Gatan Precision Ion Polishing System (PIPS), which was operated at an ion beam energy level of ~4 keV. TEM observation was carried out in a JOEL 2010 TEM. The TEM micrographs of ribbon microstructures along with the corresponding selected area diffraction patterns in the insets are shown in FIGS. 16*a* through 16*c*. As it can be seen, the nanoscale structures resulting from spinodal decomposition are interconnected nanoscale phases in a metallic glass matrix which can range in size from several nanometers to ~100 nm. For the studied alloys, it is contempated, those examples of spinodal decomposition in various forms were observed including microconstituent bands, partial decomposition, and full decomposition when uniform and periodic distribution of the crystalline phases in the amorphous matrix is formed. Note that this specific spinodal microconstituent with crystalline spinodally formed phases in an amorphous matrix is representative of the identified SGMM structure.

Case Example #6

Using the Taylor-Ulitovsky process, microwires from Alloy 3 with metal core diameter of ~33 μm, from Alloy 4 with metal core diameter of ~20 μm and from Alloy 8 with metal core diameter of ~20 μm were produced. Samples for TEM analysis were prepared by first preparing a single layer of uniformly aligned microwires array which was then fixed onto a TEM grid with a 2 mm wide slot using very tiny drops of super glue. After curing, the microwires were ion milled in a Gatan Precision Ion Polishing System (PIPS), which was operated at an ion beam energy level of ~4 keV. The ion beam incident angle was 10° first, then reduced to 7° after penetration, and finished up by further reducing the angle to 4° to assure appropriate thin area for TEM examination. Since ion-milling is a slow polishing process in which the material is gradually removed from the currently outmost surface, TEM micrographs obtained from a sharp nanoscale tip illustrate the microstructures at the microwire center. Microstructures observed in the microwires are shown in FIGS. 17*ai*, 17*bi* and 17*ci*.

The structure consists of a metallic glass matrix containing a periodic arrangement of clusters which are from 1 to 15 nm thick and 2 to 60 nm long. The periodic arrangement of clusters, their shape, and their size are indicative that they formed from a supersaturated glass matrix as a result of a spinodal decomposition. The center of microwire has a nanoscale spinodal glass matrix microconstituent structure, which has been frequently observed in melt-spun ribbons of the same alloy. The corresponding SAED patterns, shown in FIG. 17*aii*, 17*bii*, 17*cii* consist of multiple diffraction rings, including both the first bright amorphous halo of the glass matrix and the crystalline diffraction rings of the clusters. The high diffraction intensity of the amorphous halo indicates that the amorphous phase has a relatively large volume fraction forming the matrix phase of microwires. The relatively weak diffraction intensities of the crystalline diffraction rings suggest that the nanocrystals are dispersed inside the amorphous matrix.

Case Example #7

Figure 18B:
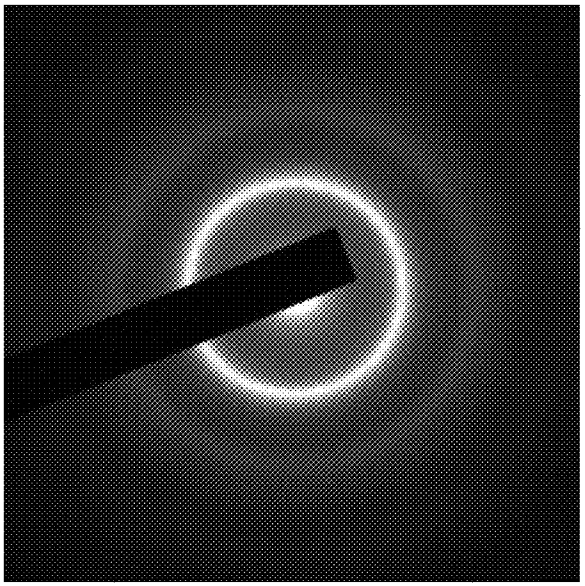
FIGS. 18*a* and 18*b* illustrate a TEM micrograph (18*a*) and the corresponding SAED (18*b*) pattern of SGMM structure in a foil from Alloy 8 produced by the Planar Flow Casting process.
Figure 18A:
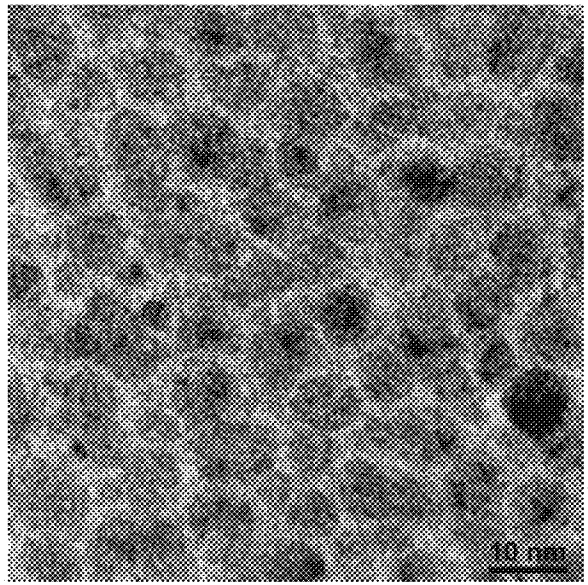

Using the planar flow casting process, foils from Alloy 8 were produced. Samples of less than 10 μm thin for TEM analysis were prepared using mechanical grinding followed by chemo-mechanical polishing. They were then ion milled until perforation using a Gatan Precision Ion Polishing System (PIPS), which was operated at an ion beam energy level of ~4 keV. TEM observation was carried out in a JOEL 2010 TEM. The TEM micrograph of the foil microstructure along with the corresponding selected area diffraction pattern are shown in FIGS. 18*a* and 18*b*. The structure consists of a metallic glass matrix containing a periodic arrangement of clusters which are 5-30 nm in size. The periodic arrangement of clusters, their shape, and their size are indicative that they formed from a supersaturated glass matrix as a result of spinodal decomposition. The corresponding SAED pattern suggests that the most of the volume remains amorphous, with semicrystalline clusters that formed and they are in the stage before forming crystals.

Case Example #8

Figure 19B:
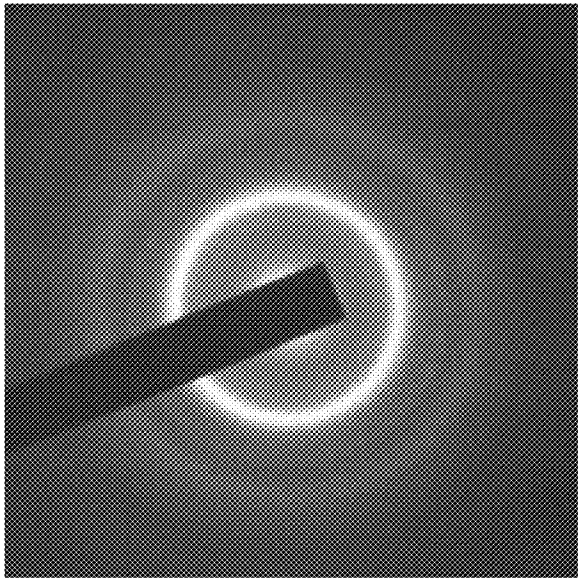
FIGS. 19*a* and 19*b* illustrate a TEM micrograph (19*a*) and SAED pattern (19*b*) of the SGMM structure in a fiber from Alloy 8 produced through the Hyperquenching process.
Figure 19A:
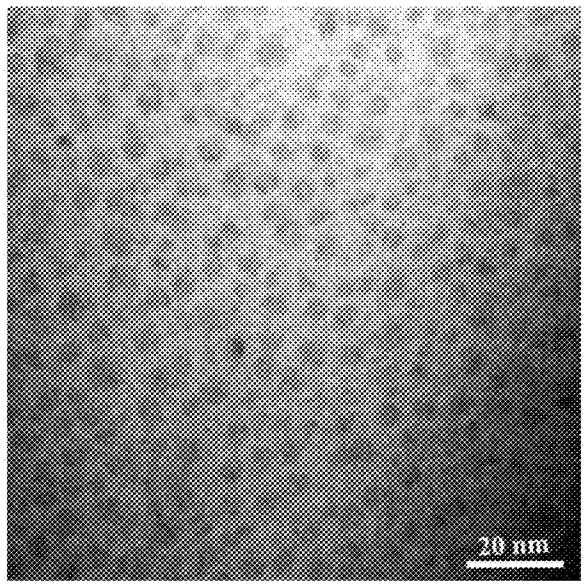

Using the hyperquenching process, fibers from Alloy 8 were produced. Samples of less than 10 μm thin for TEM analysis were prepared using mechanical grinding followed by chemo-mechanical polishing. They were then ion milled until perforation using a Gatan Precision Ion Polishing System (PIPS), which was operated at an ion beam energy level of ~4 keV. TEM observation was carried out in a JOEL 2010 TEM. The TEM micrograph of the fiber microstructure along with the corresponding selected area diffraction pattern are shown in FIGS. 19*a* and 19*b*. The structure consists of a metallic glass matrix containing a periodic arrangement of clusters which are crystalline. The periodic arrangement of clusters, their shape, and their size are indicative that they formed from a supersaturated glass matrix as a result of spinodal decomposition. The corresponding SAED pattern consists of multiple diffraction rings, including both the first bright amorphous halo of the glass matrix and the crystalline diffraction rings of the clusters. The high diffraction intensity of the amorphous halo indicates that the amorphous phase has a relatively large volume fraction forming the matrix phase of the fiber.

Case Example #9

Figure 20B:
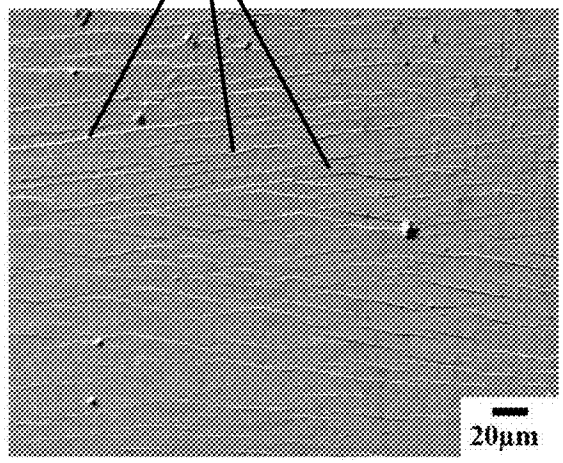
FIGS. 20*a* and 20*b* illustrate an SEM image of multiple shear bands on a surface of melt-spun ribbon from Alloy 1 after tensile testing.
Figure 20A:
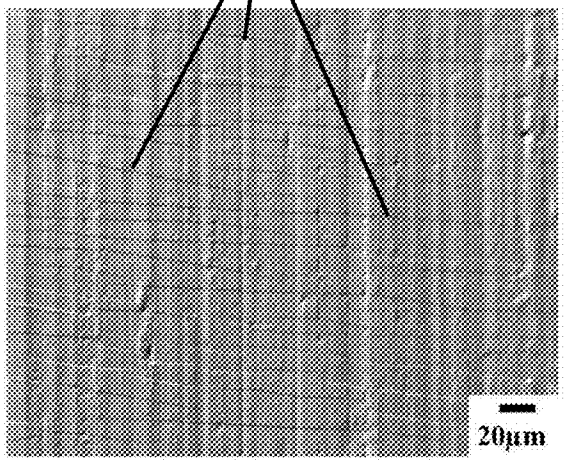

Using high purity elements, a 15 g alloy feedstock of the Alloy 1 was weighed out according to the atomic ratio's provided in Table 1. The feedstock material was then placed into the copper hearth of an arc-melting system. The feedstock was arc-melted into an ingot using high purity argon as a shielding gas. The ingot was flipped and re-melted several times to ensure composition homogeneity. After mixing, the ingot was then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted in the crucible using RF induction and then ejected onto a 245 mm diameter copper wheel at a tangential speed of 16 m/s. Melt-spun ribbons were tested in tension and the surface of a selected tested ribbon was examined by SEM using secondary electron imaging. After deformation, high shear band (SB) number per linear meter was observed on the ribbon surface as shown in FIGS. 20*a* and 20*b*. It may be appreciated that in conventional metallic glasses unconstrained loading conditions such as tensile testing may usually result in one single runaway shear band that leads to failure. The number of shear bands per linear meter are $1.06\times10^5$ $m^{-1}$ for FIGS. 20A and $1.14\times10^5$ $m^{-1}$ for FIG. 20B.

Case Example #10

Figure 21B:
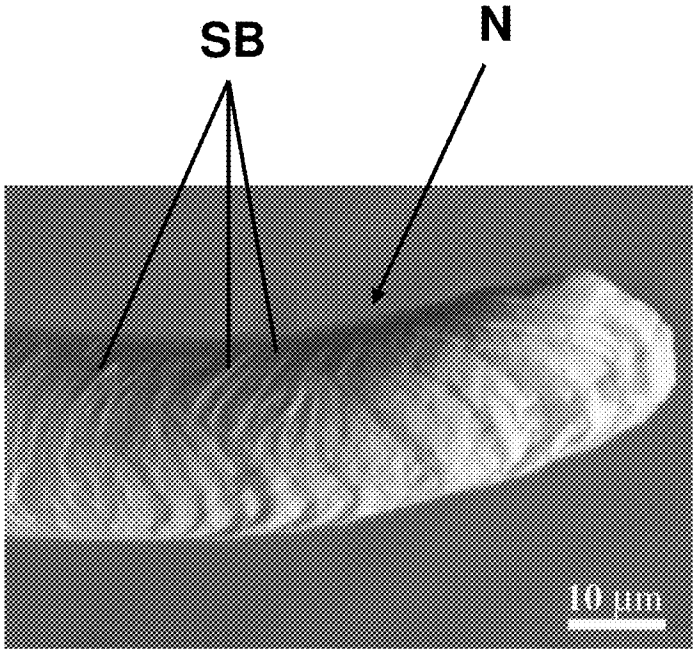
FIGS. 21*a* and 21*b* illustrate multiple shear bands on the surface of the microwire from Alloy 2 after tensile testing (FIG. 21*a*) and necking prior to failure (FIG. 21*b*).
Figure 21A:
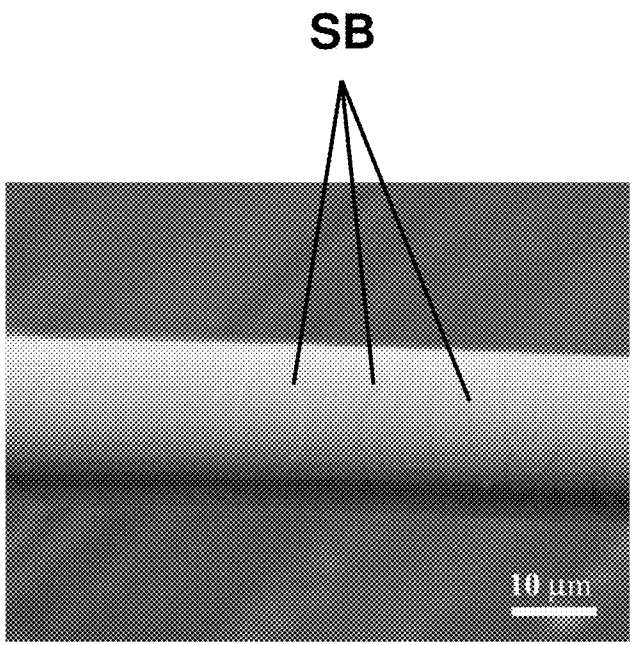

Using the Taylor-Ulitovsky process, a microwire from Alloy 2 was produced. The microwire was tested in tension and the surface of the tested wire was examined by SEM using an EVO-60 scanning electron microscope manufactured by Carl Zeiss SMT Inc. Typical operating conditions were electron beam energy of 17.5 kV, filament current of 2.4 A, and spot size setting of 800. Energy Dispersive Spectroscopy was conducted with an Apollo silicon drift detector (SDD-10) using Genesis software both of which are from EDAX. The amplifier time was set to 6.4 micro-sec so that the detector dead time was about 12-15%. After deformation, high number of shear bands (SB) per linear meter was observed on the microwire surface as shown in FIGS. 21*a* and 21*b*. Moreover, extensive necking (N) was detected in the microwire prior to failure (FIG. 21*b*). In FIGS. 21*a* and 21*b*, the number of shear bands (SB) per linear meter are $2.50\times10^5$ $m^{-1}$ and $6.30\times10^5$ $m^{-1}$ for the uniformly deformed region and the necking (N) region in the tensile tested microwire, respectively.

Case Example #11

Figure 22:
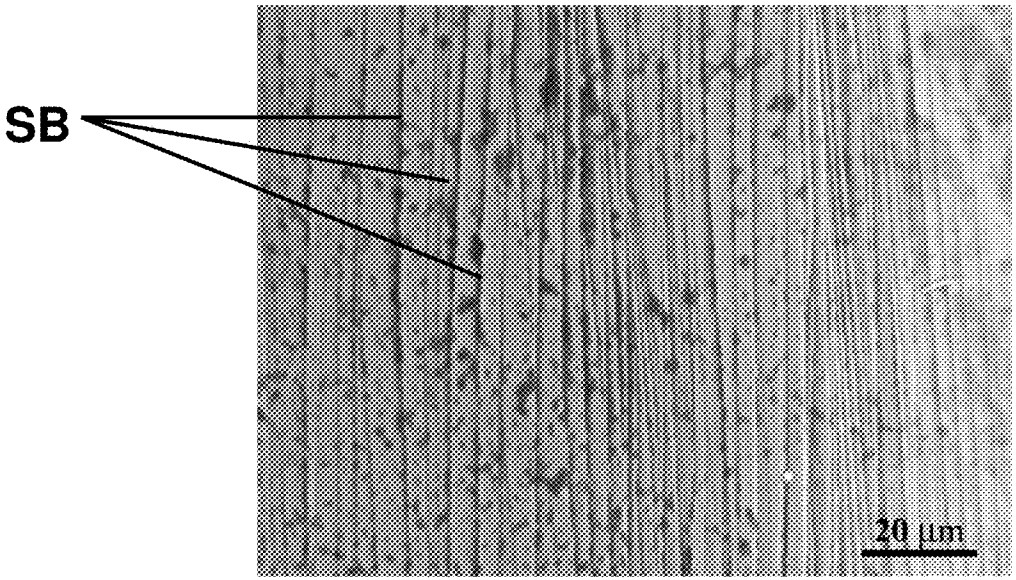
FIG. 22 illustrates multiple shear bands on the surface of the foil from Alloy 1 (tension side) after bend testing.

Using the Planar Flow Casting process, a foil from Alloy 1 was produced. The foils were tested by 180° bending and the surface of the tested specimen was examined by SEM using an EVO-60 scanning electron microscope manufactured by Carl Zeiss SMT Inc. Typical operating conditions were electron beam energy of 17.5 kV, filament current of 2.4 A, and spot size setting of 800. Energy Dispersive Spectroscopy was conducted with an Apollo silicon drift detector (SDD-10) using Genesis software both of which are from EDAX. The amplifier time was set to 6.4 micro-sec so that the detector dead time was about 12-15%. After deformation, high shear band density, or number of shear bands per unit measurement, was observed on the foil surface as shown in FIG. 22. Again, as may be appreciated, in conventional metallic glasses unconstrained loading conditions such as tensile testing may usually result in one single runaway shear band. Accordingly, when the foil herein was tested by 180° bending, the number of shear bands per linear meter on the tension side in FIG. 22 was $3.55\times10^5$ $m^{-1}$.

Case Example #12

Figure 23:
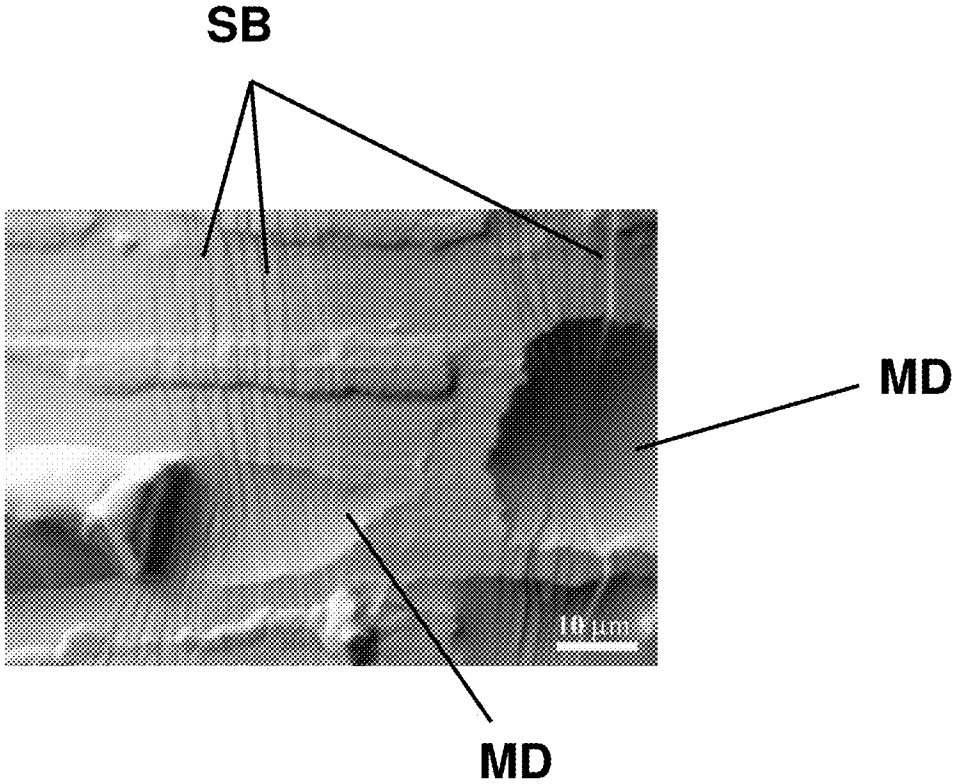
FIG. 23 illustrates multiple shear bands on the surface of the fiber from Alloy 8 after bend testing.

Using the hyperquenching process, fibers from Alloy 8 were produced. The fibers were tested by 180° bending and the surface of the tested fibers was examined by SEM using an EVO-60 scanning electron microscope manufactured by Carl Zeiss SMT Inc. Typical operating conditions were electron beam energy of 17.5 kV, filament current of 2.4 A, and spot size setting of 800. Energy Dispersive Spectroscopy was conducted with an Apollo silicon drift detector (SDD-10) using Genesis software both of which are from EDAX. The amplifier time was set to 6.4 micro-sec so that the detector dead time was about 12-15%. After deformation, high shear band (SB) density, or number of shear bands per linear meter, was observed on the fiber surface as shown in FIG. 23. In spite of the extensive number of macrodefects (MD), crack initiation was not observed from stress concentrations indicating that the shear band deformation mechanisms were active to accommodate deformation in the defected areas. The surface of the fibers as shown indicated a number of shear bands per linear meter on the tension side of $6.12\times10^5$ $m^{-1}$.

Case Example #13

Using high purity elements, a 15 g alloy feedstock of Alloy 1 was weighed out according to the atomic ratios provided in Table 1. The feedstock material was then placed into the copper hearth of an arc-melting system. The feedstock was arc-melted into an ingot using high purity argon as a shielding gas. The ingot was flipped and re-melted several times to ensure composition homogeneity. After mixing, the ingot was then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted using RF induction and then ejected onto a 245 mm diameter copper wheel traveling at a tangential velocity of 10.5 m/s. The ribbon was 1.33 mm wide and 0.07 mm thick. Melt-spun ribbons were tested in tension and from selected samples TEM foils were prepared from the gauge of tested specimen using mechanical grinding to less than 10 μm followed by chemo-mechanical polishing. They were then ion milled until perforation using a Gatan Precision Ion Polishing System (PIPS), which was operated at an ion beam energy level of ~4 keV. TEM observation was carried out in a JOEL 2010 TEM.

Figure 24:
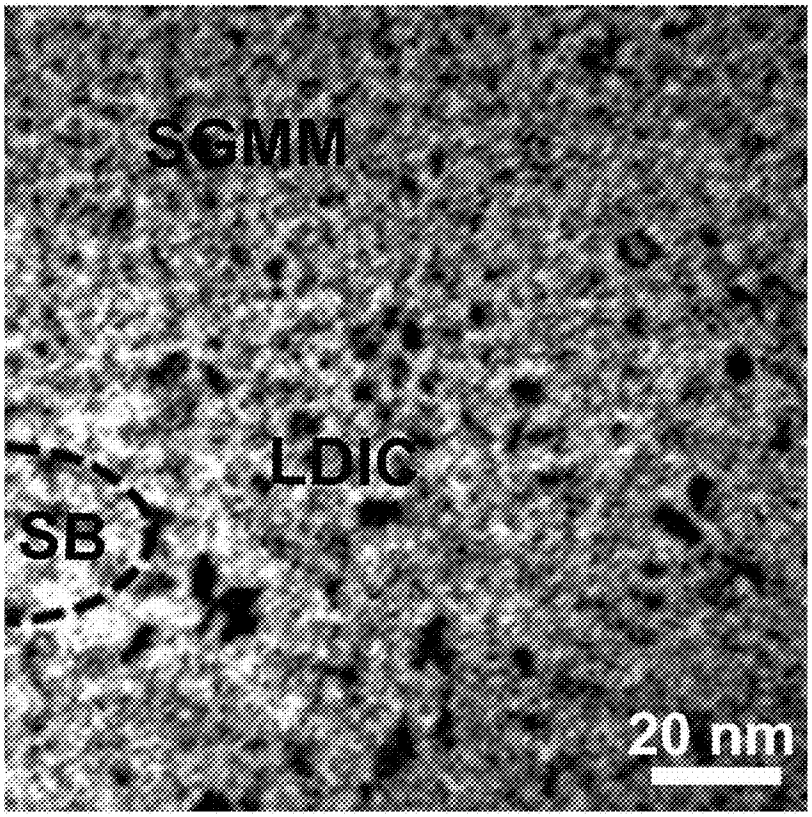
FIG. 24 illustrates localized deformation induced changes (LDIC) occurring ahead of the moving shear band are shown near the middle of the TEM micrograph in front of a shear band which is moving from left to right.
Figure 25A:
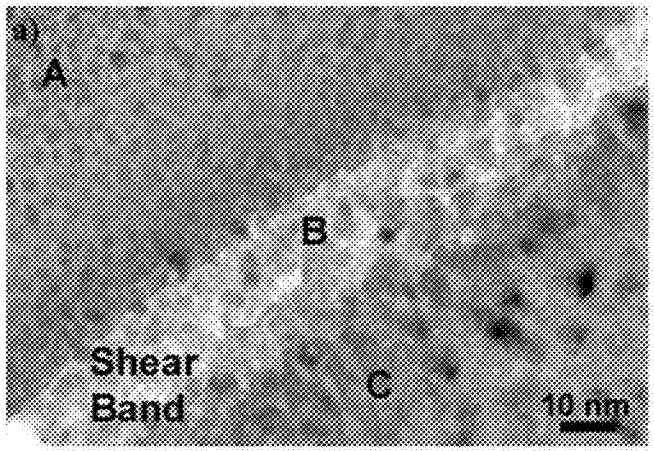
FIGS. 25*a* and 25*b* illustrate a TEM micrograph of the localized deformation induced changes (LDIC) around a shear band (FIG. 25*a*) and corresponding selected area electron diffraction (SAED) patterns showing phase transformation induced by propagating shear band (FIG. 25*b*).
Figure 25B:
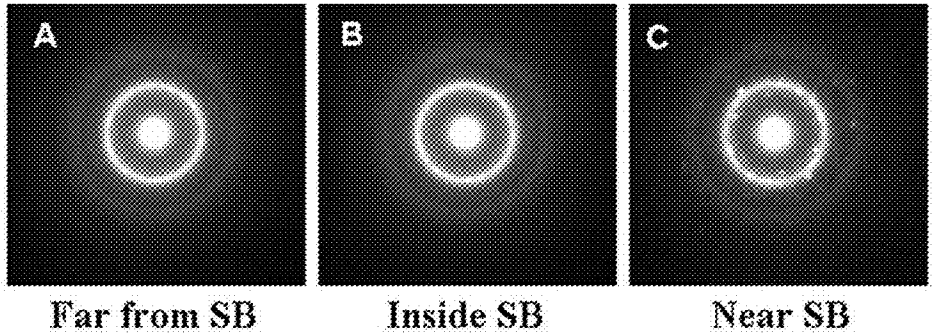

Interactions of moving shear bands with the SGMM structure result in Localized Deformation Induced Changes (LDIC). Identified LDIC include in-situ nanocrystallization, grain/phase growth, and phase changes. The TEM micrographs of the deformed ribbon showing nanocrystallization and grain growth ahead of the propagating shear band are presented in FIG. 24 represents an example of phase transformations in the microstructure of deformed ribbon from Alloy 1 caused by propagating shear bands. The SAED patterns A, B, and C in FIG. 25*b*, respectively, correspond to the three regions A, B, and C in FIG. 25*a*. Changes in both diffraction rings and diffraction spots in the SAED patterns taken from areas inside and near propagating shear band as compared to that taken from undeformed area confirm phase transformations induced by shear deformation.

Case Example #14

Using high purity elements, 15 g alloy feedstocks of the Alloy 1 and Alloy 4 were weighed out according to the atomic ratio's provided in Table 1. The feedstock material was then placed into the copper hearth of an arc-melting system. The feedstock was arc-melted into an ingot using high purity argon as a shielding gas. The ingot was flipped and re-melted several times to ensure composition homogeneity. After mixing, the ingot was then cast in the form of a finger approximately 12 mm wide by 30 mm long and 8 mm thick. The resulting fingers were then placed in a melt-spinning chamber in a quartz crucible with a hole diameter of ~0.81 mm. The ingots were melted using RF induction and then ejected onto a 245 mm diameter copper. Melt-spinning parameters are specified in Table 2. Melt-spun ribbon was tested in tension and TEM foils of less than 10 μm thin were prepared from the gauge of tested specimen using mechanical grinding followed by chemo-mechanical polishing. They were then ion milled until perforation using a Gatan Precision Ion Polishing System (PIPS), which was operated at an ion beam energy level of ~4 keV. TEM observation was carried out in a JOEL 2010 TEM.

Figure 26B:
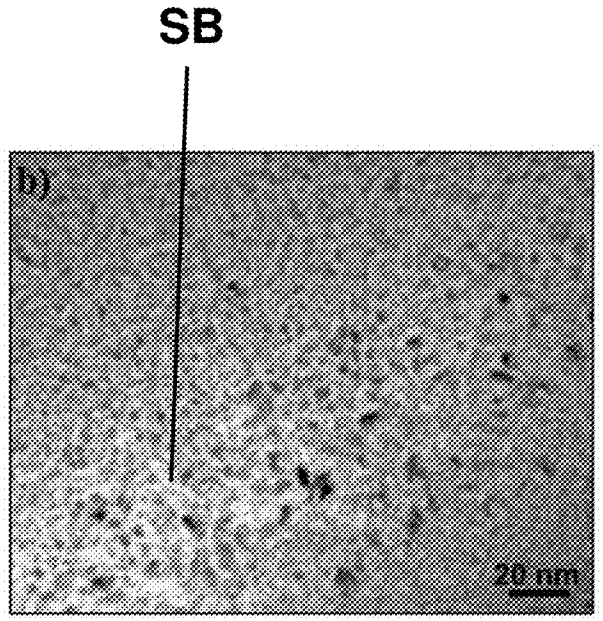
FIGS. 26*a* and 26*b* illustrate Induced Shear Band Blunting (ISBB) in deformed melt-spun ribbon from Alloy 1 caused by interaction of propagating shear band with SGMM structure (FIG. 26*a*) and an enlarged image of the area marked D in (a) showing LDIC ahead of propagating shear band (FIG. 26*b*).
Figure 26A:
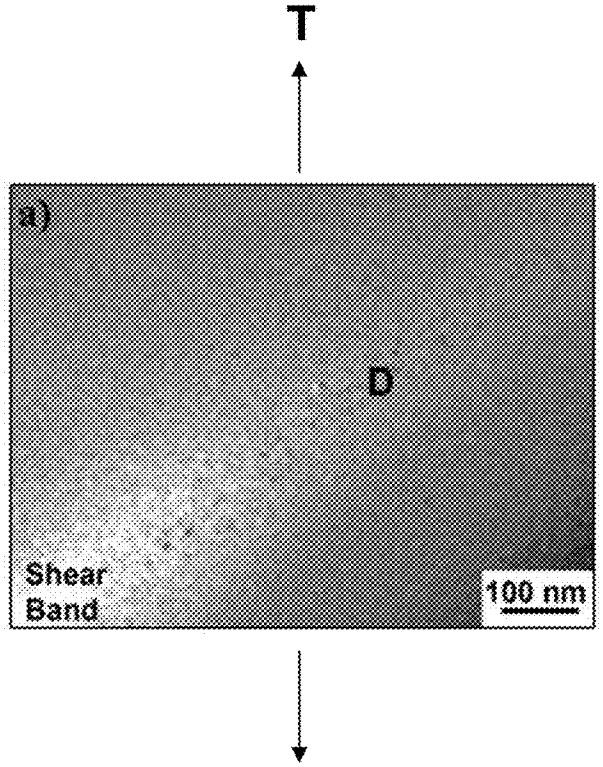
Figure 27A:
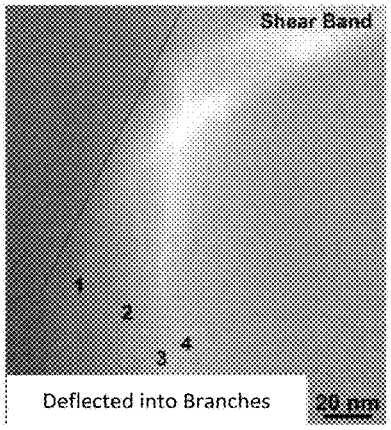
FIGS. 27*a* and 27*b* illustrate a TEM image of Shear Band Arresting Interactions (SBAI) in deformed melt-spun ribbon from Alloy 4 (FIG. 27*a*) and an Enlarged TEM image of the shear band interaction area showing shear band branching and arresting (FIG. 27*b*).
Figure 27B:
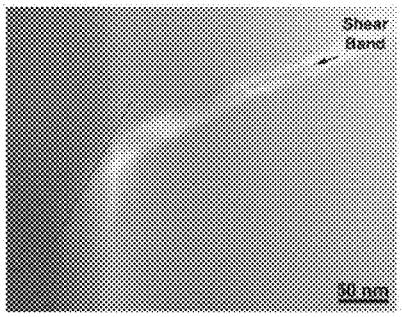

The TEM studies show two distinct types of shear band interactions ISBB and SBAI. In FIGS. 26*a*, a TEM micrograph is shown illustrating the ISBB mechanism whereby a shear band oriented ~40° from the tensile axis (T) is observed in the middle of the figure moving from left to right. The interaction between the shear band and the SGMM structure is complex and in FIG. 26*b*, the tip of a shear band is shown which clearly illustrates that after the shear band is blunted, long range stress fields are created in the direction of the long axis of the shear band resulting in extended (up to several hundred nm) LDIC occurring beyond the shear transformation zone. In FIGS. 27*a* and 27*b*, details on the SBAI mechanism can be seen, when two shear bands, after interacting, split into four separate fine branches (1, 2, 3, 4) which are quickly arrested after a short linear distance.

Thus, the SGMM structure has the inherent ability to stop a propagating shear band (ISBB) and that once blunted, shear bands which are subsequently activated through additional stress are arrested through SBAI. It is contemplated that the culmination of these complex interactions then allows for multiple shear banding and global plasticity observed in the studied alloys in different product forms.

Case Example #15

Figure 28:
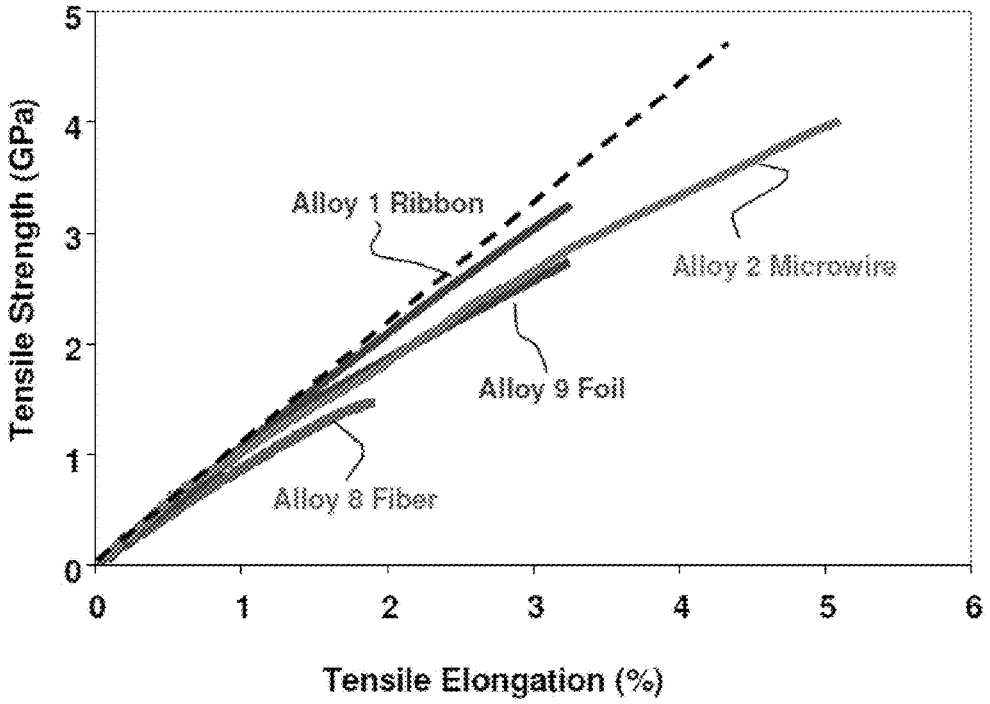
FIG. 28 illustrates a stress—strain curves for various commercial product forms including a melt-spun ribbon from Alloy 1, a microwire from Alloy 2 produced by the Taylor-Ulitovsky process, a foil from Alloy 9 produced by the Planar Flow Casting process, and a fiber from Alloy 8 produced by the hyperquenching process.

SGMM structure exhibits strain hardening during tensile testing requiring progressively higher force to maintain continuous plastic deformation. An example of stress-strain curves for each type of studied product forms are shown in FIG. 28. The mechanical properties of the product forms were obtained at room temperature using microscale tensile testing. The testing was carried out in a commercial tensile stage made by Ernest Fullam Inc., which was monitored and controlled by a MTEST Windows software program. The deformation was applied by a stepping motor through the gripping system while the load was measured by a load cell that was connected to the end of one gripping jaw. Displacement was obtained using a Linear Variable Differential Transformer (LVDT) which was attached to the two gripping jaws to measure the change of gauge length. Before testing, the thickness and width of a tensile specimen was carefully measured at least three times at different locations in the gauge length. The average values were then recorded as gauge thickness and width, and used as input parameters for subsequent stress and strain calculation. The initial gauge length for tensile testing was set at ~7 to ~9 mm with the exact value determined after the product was fixed, by accurately measuring the span between the front faces of the two gripping jaws. All tests were performed under displacement control, with a strain rate of ~0.001 $s^{-1}$.

The level of tensile strength and ductility depends on alloy composition, geometrical parameters of product form, quality of produced product (controlled by production process optimization for each alloy) and testing conditions. Nevertheless, as the tensile curves show, after the yield strength is exceeded, typically at 1.0 to 1.5% of elastic strain, the SGMM alloy continues to gain strength until failure regardless the product form and quality. Typically, shear deformation requires dilation and necessitates the creation of free volume which promotes a local decrease in viscosity leading to strain softening and catastrophic failure.

Case Example #16

Using the Taylor-Ulitovsky process, a microwire from Alloy 3 was produced with a metal core diameter at 20 μm. The microwire was tested in torsion by taking a 40 mm microwire segment and fixing this to a beam. A dead load of 1.0 g mass was then attached to the end of the microwire sample which corresponds to a load of ~32 MPa. The resulting torsional load was applied by manually turning the dead load and the total number of turns were counted and used to calculate the shear strain. The testing results are presented in Table 18. As shown, the shear strain on breaking is from 5.79% to 7.03%.

TABLE 18

Results of Torsion-Tension Testing on Microwires

| Test ID | Wire Core Diameter (μm) | Gauge Length (mm) | Break-to-End Length (mm) | Number of turns on breaking | Shear Strain on Breaking (%) |
|---|---|---|---|---|---|
| 1 | 20.0 | 60 | 55 | 57 | 5.97 |
| 2 | 20.0 | 40 | 38 | 41 | 6.44 |
| 3 | 20.0 | 50 | 45 | 56 | 7.03 |

Figure 29:
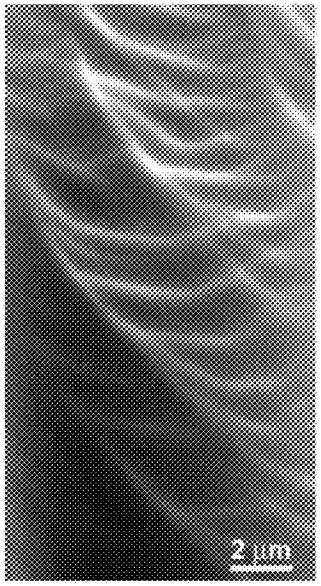
FIG. 29 is an SEM micrograph showing multiple levels of shear bands in a surface of an Alloy 3 microwire sample that was tested under unconstrained tension-torsion loading.

The surfaces of the torsion tested microwires were examined in an EVO-60 scanning electron microscope manufactured by Carl Zeiss SMT Inc. For an Alloy 3 microwire that was tested under unconstrained tension-torsion loading, at least three levels of shear bands involving shear band formation, shear band blunting and shear band arresting with existing shear bands, were formed (FIG. 29). The number of shear bands per linear meter was calculated and was at $2.25\times10^6$ $m^{-1}$. It should be noted that an even higher level of shear banding may be present but not revealed due to the spatial resolution available in the SEM. Thus, the shear band density calculation is conservative.

Shear Band Density

As can be seen from the above, the alloy chemistry selection and processing conditions to provide the macroscopic plastic deformation in metallic glass alloys or metallic glass matrix composites result in shear band deformation. A shear band, with a certain thickness in the range of 10 nm to 100 nm, including all values and ranges therein, is now formed as the result of the focused shear deformation between two neighboring volumes that are separated by the band itself. Since it is a through thickness deformation, the number of shear bands per linear meter that is developed herein may also be quantified and associated with the indicated alloys as the volume fraction of the shear bands in a macroscopically deformed sample.

The quantification of the number of shear bands per linear unit, such as linear meter, as an additional characteristic installed in the alloys disclosed herein may now be identified when materials are subjected to uniaxial loading conditions when the majority of shear bands are roughly parallel. In this case, the shear band density may now be quantified as the number of shear bands that are crossed by a linear length in a direction that is locally perpendicular to the shear band traces on the surface. The number-per-unit-length definition ($m^{-1}$) can also be applied to shear bands that have a roughly uniform orientation in materials with a thin and wide cross section under uniaxial loading. With more complex stress states such as a uniaxial load with torsion, the shear bands will have multiple orientations and even higher shear band densities which now can be identified using a similar approach.

In unconstrained loading, such as in tension, shear bands in metallic glasses or metallic glass composite materials may be relatively low. Typically, failure can occur with the nucleation and resulting propagation of a single shear band with no measurable global plasticity. Since the typical gauge length is in the range from 9 mm to 40 mm, the number of shear bands per linear meter may be understood herein to be from $2.5\times10^1$ $m^{-1}$ to $1.1\times10^2$ $m^{-1}$.

In materials including SGMM structure and the alloy chemistries as identified herein at least two mechanisms have been developed to promote the creation of relatively high shear band densities: ISBB and SBAI. As shown by the case examples above, relatively high number of shear bands per linear meter may be exhibited in the range of $10^5$ to $10^6$ $m^{-1}$ upon failure when tensile force is applied at a strain rate of 0.001 $s^{-1}$. It is contemplated that achieving relatively lower shear band densities in the SGMM structure is also achievable since shear bands are continuously generated after the yield strength is exceeded until failure. To develop shear band densities, a number of shear bands per linear meter, in the $10^2$ to $10^5$ $m^{-1}$ range in materials with the SGMM structure, the deformation may be stopped at the intermediate stage before failure. Thus, the shear band density range for the SGMM materials disclosed herein is a shear band density, a number of shear bands per linear meter, of greater than $1.1\times10^2$ $m^{-1}$, such as in the range of $10^2$ $m^{-1}$ to $10^7$ $m^{-1}$, including all values and ranges therein, in increments of 10 $m^{-1}$. Accordingly, the present invention relates to the metallic alloy chemistries herein, which are susceptible to SGMM structural formation, together with the ability to undergo ISBB and/or SBAI, to provide shear band densities, a number of shear bands per linear meter, of greater than $1.1\times10^2$ $m^{-1}$ to $10^7$ $m^{-1}$.

The foregoing description of several methods and embodiments has been presented for purposes of illustration. It is not intended to be exhaustive or to limit the claims to the precise steps and/or forms disclosed, and obviously many modifications and variations are possible in light of the above teaching. It is intended that the scope of the invention be defined by the claims appended hereto.

What is claimed is:

1. A method of forming an alloy composition including spinodal based glass matrix microconstituents comprising:

melting an alloy composition comprising iron present in the range of 49 atomic percent (at %) to 65 at %, nickel present in the range of 10 at % to 16.5 at %, cobalt optionally present in the range of 0.1 at % to 12 at %, boron present in the range of 12.5 at % to 16.5 at %, silicon present in the range of 0.1 at % to 8.0 at %, carbon optionally present in the range of 2 at % to 5 at %, chromium optionally present in the range of 2.5 at % to 13.35 at %, niobium optionally present in the range of 1.5 at % to 2.5 at %; and cooling said alloy composition at a rate of $10^3$ K/s to $10^6$ K/s and triggering the formation of a spinodal glass matrix microconstituent in said alloy composition, wherein said alloy composition upon cooling exhibits uniform phase separation of semicrystalline or crystalline clusters in a metallic glass matrix, wherein the clusters exhibit different chemistry from the glass matrix, and said alloy composition exhibits a thickness of 0.001 mm to 3 mm and exhibits an ultimate tensile strength in the range of 2.3 Gigapascals (GPa) to 3.27 GPa, when measured at a strain rate of 0.001 $s^{-1}$, and wherein melting and cooling of said alloy is by melt-spinning in a gas environment with a chamber pressure in the range of 0.25 atm to ⅓atm and a wheel tangential velocity in the range of 15 meters per second to 30 meters per second, wherein said gas environment is selected from one of the following: carbon dioxide, carbon dioxide and carbon monoxide mixtures, or carbon dioxide and argon mixtures.

2. The method of claim 1, wherein said alloy composition consists essentially of iron, nickel, boron, silicon and one or more of the following cobalt, chromium, carbon and niobium.

3. The method of claim 1, wherein said alloy composition consists essentially of iron, nickel, boron, silicon and chromium.

4. The method of claim 1, wherein said alloy composition comprises iron present in the range of 49 at % to 65 at %, nickel present in the range of 14.5 at % to 16.5 at %, cobalt present in the range of 2.5 at % to 12 at %, boron present in the range of 12.5at % to 16.5 at %, silicon present in the range of 0.5 at % to 8.0 at %, carbon optionally present in the range of 2 at % to 5 at %, chromium optionally present in the range of 2.5 at % to 13.35 at %, and niobium optionally present in the range of 1.5 at % to 2.5 at %.

5. The method of claim 1, wherein said alloy composition comprises iron present in the range of 53 at % to 62 at %, nickel present in the range of 15.5 at % to 16.5 at %, cobalt present in the range of 4.0 at % to 10 at %, boron present in the range of 12 at % to 16 at %, carbon present in the range of 4.5 at % to 4.6 at %, and silicon present in the range of 0.4 at % to 0.5 at %.

6. The method of claim 1, wherein said alloy composition comprises iron present in the range of 51 at % to 65 at %, nickel present in the range of 16.5 at %, cobalt present in the range of 3 at % to 12 at %, boron present in the range of 15 at % to 16.5 at %, and silicon present in the range of 0.4 at % to 4 at %.

7. The method of claim 1, wherein said alloy composition comprises iron present in the range of 49 at % to 61 at %, nickel present in the range of 14.5 at % to 16 at %, cobalt present in the range of 2.5 at % to 12 at %, boron present in the range of 13 at % to 16 at %, silicon present in the range of 3 at % to 8 at %, and chromium present in the range of 2.5 at % to 3 at %.

8. The method of claim 1, wherein said alloy composition comprises iron present in the range of 57 at % to 60 at %, nickel present in the range of 14.5 at % to 15.5 at %, cobalt present in the range of 2.5 at % to 3 at %, boron present in the range of 13 at % to 14 at %, silicon present in the range of 3.5 at % to 8 at %, chromium present in the range of 2.5 at % to 3 at %, and niobium optionally present at 2 at %.

9. The method of claim 1, wherein said alloy composition does not include cobalt.

10. The method of claim 1, wherein said alloy composition comprises iron present in the range of 52 at % to 65 at %, nickel present in the range of 10 at % to 16.5 at %, boron present in the range of 13 at % to 15 at %, silicon present in the range of 0.4 at % to 0.5 at %, and chromium present in the range of 3 at % to 13.35 at %.

11. The method of claim 1, wherein said spinodal glass maxtrix microconstituents include crystalline or semi-crystalline clusters having a size in the range of 1nm to 15 nm in thickness and 2 nm to 60 nm in length.

12. The method of claim 1, wherein said alloy composition exhibits a glass to crystalline onset to peak in the range of 395° C. to 576° C., when measured at a rate of 10° C./min.

13. The method of claim 1, wherein said alloy composition exhibits a primary onset glass transition temperature in the range of 395° C. to 505° C. and a primary peak glass transition temperature in the range of 419° C. to 521° C., when measured at a rate of 10° C./min.

14. The method of claim 1, wherein said alloy composition exhibits a total elongation in the range of 2.27% to 4.78%, when measured at a strain rate of 0.001 $s^{-1}$.

15. The method of claim 1, wherein said alloy composition exhibits an average microhardness in the range of 9.10 GPa to 9.21 GPa when tested under a 50 gram load.

16. The method of claim 1, wherein said alloy composition develops a number of shear bands per linear meter in the range of greater than $1.1\times10^2$ $m^{-1}$ to $10^7$ $m^{-1}$ upon application of a tensile force applied at a rate of $0.001s^{-1}$.

* * * * *